US009829263B2

(12) United States Patent
Bonner

(10) Patent No.: US 9,829,263 B2
(45) Date of Patent: Nov. 28, 2017

(54) RAPID RESET FIRE CONTROL

(71) Applicant: James Dillon Bonner, Smyrna, TN (US)

(72) Inventor: James Dillon Bonner, Smyrna, TN (US)

( * ) Notice: Subject to any disclaimer, the term of this patent is extended or adjusted under 35 U.S.C. 154(b) by 0 days.

(21) Appl. No.: 14/601,209

(22) Filed: Jan. 20, 2015

(65) Prior Publication Data

US 2016/0010933 A1 Jan. 14, 2016

Related U.S. Application Data

(60) Provisional application No. 61/965,045, filed on Jan. 18, 2014.

(51) Int. Cl.
*F41A 19/10* (2006.01)
*F41A 19/14* (2006.01)

(52) U.S. Cl.
CPC ..... *F41A 19/10* (2013.01); *F41A 19/14* (2013.01)

(58) Field of Classification Search
CPC ..... F41A 19/10; F41A 19/14
USPC ..... 89/136, 129.01, 129.02, 131, 141, 147, 89/151; 42/69.02, 69.03
See application file for complete search history.

(56) References Cited

U.S. PATENT DOCUMENTS 5,760,328 A * 6/1998 Robbins ..... F41A 19/46 89/129.02
6,615,527 B1 * 9/2003 Martin ..... F41A 19/46 42/20
7,398,723 B1 * 7/2008 Blakley ..... F41A 19/12 42/69.01
7,854,084 B1 * 12/2010 Rutherford ..... F41A 19/10 42/69.01
2006/0101695 A1 * 5/2006 Longueira ..... F41A 9/45 42/69.02

* cited by examiner

*Primary Examiner* — Reginald Tillman, Jr.

(57) ABSTRACT

The present invention is an instrument for the rapid firing of a self-loading firearm in a manner which was not previously possible. Some exemplary embodiments of the present invention comprise a fire control group for firearms essentially conforming to semi-automatic fire control groups as known to the art with the addition of novel features, as described herein, which temporarily transfer hammer spring force to the trigger after the firearm has fired live ammunition, resulting in the urging of the trigger to its reset position by hammer spring force. This temporary use of hammer spring force to urge the trigger to its reset position enables more controllable rapid firing of the firearm and other attributes.

4 Claims, 17 Drawing Sheets

RAPID RESET FIRE CONTROL

CROSS-REFERENCE TO RELATED APPLICATIONS

The present application claims priority of U.S. Provisional Application No. 61/965,045 filed Jan. 18, 2014 by the present inventor, titled: Rapid Reset Fire Control.

FEDERALLY SPONSORED RESEARCH

NONE

SEQUENCE LISTING

NONE

FIELD OF THE INVENTION

The present invention relates to firearms. More specifically, the present invention relates to firearm fire control groups comprising a pivotal hammer.

BACKGROUND OF THE INVENTION

Self-loading firearms are presently in use throughout the world and have become the dominate firearm type in modern manufacture. Chief among the advantages which have lead to the domination of self-loading firearms is the utility of various rapid fire capabilities which self-loading firearms known to the art are capable of.

Self-loading firearms are those wherein the next live ammunition cartridge loads after a live ammunition cartridge has been fired. Once the firearm is made ready to fire, the user need only interact with the fire control group of the firearm in order to fire a live ammunition cartridge and load the next available live ammunition cartridge from a magazine, belt or other ammunition feeding device, such that the firearm is made ready to fire again without additional user interaction.

The fire control groups for self-loading firearms known to the art frequently share many characteristics of how they are operated by the user. For most such fire control groups a semi-automatic firing mode is provided. Said semi-automatic firing mode is such that the user fires the firearm by using a finger to apply force to the trigger of the fire control group until the trigger is moved from its reset position to its firing position, at which point a live ammunition cartridge is fired. Once the firearm has been fired in said manner, in order for the user to fire an additional live ammunition cartridge, the user reduces the force being applied to the trigger with his or her finger, thus allowing the trigger to return to its reset position. After this, the user again applies increasing force with his or her finger to the trigger until the trigger is again moved to its firing position, causing the firearm to fire an additional live ammunition cartridge. This process may be further repeated to continue firing additional live ammunition cartridges until live ammunition cartridges are no longer available to the firearm.

This semi-automatic firing mode as found in semi-automatic fire control groups known to the art is disadvantageous for multiple reasons, including but not limited to:

a) Firing multiple live ammunition cartridges requires the user to both increase and decrease the force applied to the trigger with his or her finger. This requirement is time consuming and significantly limits the potential rate of fire.

b) The repeated alternation between contraction and relaxation of the muscles in the users finger is physically taxing, and thus, may induce cramps and even exhaust the ability of the users finger to pull the trigger at the desired rate of fire.

c) The time consumed by the requirement for the user to reduce force applied to the trigger in order for the next live ammunition cartridge to be fired may be in excess of the time required for the user to aim the firearm, resulting in an unnecessary delay between the firings of live ammunition cartridges.

d) A trigger spring with significant strength is required to bias the trigger towards its reset position. This results in a heavier trigger pull weight.

These and other disadvantages in the state of the art have led to the incorporation into many fire control group designs both a semi-automatic mode as previously described, and an additional fully-automatic mode of fire. Said fully-automatic mode of fire is such that the firearm will continue firing live ammunition cartridges as long as the trigger is held in the firing position and the firearm has available live ammunition cartridges. This fire control group with both semi-automatic and fully-automatic firing modes alleviates some of the above disadvantages found in firearms which are only capable of semi-automatic fire.

However, fire control groups with both semi-automatic and fully-automatic firing modes, as known to the art, suffer from a number of disadvantages, including but not limited to:

a) Many firearms known to the art which incorporate fire control groups with both a semi-automatic and a fully-automatic firing mode also incorporate a selector switch which the user must manipulate in order to change between the low rate of fire semi-automatic firing mode and the high rate of fire fully-automatic firing mode. Manipulating such a selector switch is time consuming and burdensome for the user of the firearm.

b) Firearms known to the art which incorporate fire control groups with both a semi-automatic and a fully-automatic firing mode require additional parts and complexity when compared to firearms which only incorporate a semi-automatic firing mode. This is a burden on manufacturing and can be a source of reliability problems and increased cost.

c) The fully-automatic firing mode of many firearms known to the art typically does not provide the capability for the user to adjust the rate of fire of the firearm during the process of firing the firearm.

d) Firearms known to the art which incorporate a fully-automatic firing mode often have an excessively high rate of fire, this excessively high rate of fire produces a recoil force beyond that which is easily controlled by the user. This excessively high rate of fire may result in the firearm dangerously and uncontrollably drifting off of the desired target. Such an excessively high rate of fire may also consume ammunition at an undesirably high rate.

e) Under stress the firearm user may unintentionally clinch his or her firing hand, depressing the trigger with his or her finger. This can result in the firearm entering a very dangerous runaway firing condition at a high rate of fire until the user regains control of the firearm or the firearm runs out of ammunition.

The above disadvantages present in fire control groups known to the art which incorporate a fully-automatic firing mode have led to many firearm designs which incorporate a feature called arate-reducer. This feature typically comprises a mechanical device installed within the firearm which slows the firing rate of the firearm during firing in fully-automatic mode in order to alleviate some of the above disadvantages found in firearms with fully-automatic firing modes.

However, firearms operating in fully-automatic mode while equipped with a rate-reducer still suffer from disadvantages, including but not limited to:

a) Firearms known to the art which incorporate a rate-reducer for reducing the fully-automatic firing rate require additional parts and complexity. This is a burden on manufacturing and can be a cause of reliability problems and increased cost.

An example of an attempt to resolve the aforementioned disadvantages of semi-automatic fire control groups can be found in U.S. Pat. No. 8,371,208 to Cottle, wherein a sliding articulation is added to the firearm stock such that when the firearm fires live ammunition the resultant recoil force moves the receiver of the firearm away from the users finger. This movement of the firearm away from the users finger allows the trigger to return to its reset position. Said movement of the trigger to the reset position as a result of recoil force allows for a faster rate of fire. However, this concept adds considerable complexity to the firearm, does not lend itself to practical use and has proven to be unreliable for many users. Thus, this concept does not resolve the existing disadvantages in the state of the art.

Another example of an attempt to resolve the disadvantages of semi-automatic fire control groups is U.S. Pat. No. 8,667,881 to Hawbaker, wherein a fire control group is described which fires live ammunition both when the trigger is moved to the firing position, and also when the trigger is returned to the reset position. This concept essentially doubles the potential rate of fire compared to a typical semi-automatic fire control group. However this concept does not approach the high rate of fire of many fully-automatic fire control groups. Additionally, it adds considerable complexity to the fire control group when compared to typical semi-automatic fire control groups as known to the art. As such, this concept does not resolve the existing disadvantages in the state of the art.

A further example of an attempt to resolve the disadvantages of semi-automatic fire control groups is U.S. Pat. No. 5,074,190 to Troncoso, wherein an apparatus which provides spring bias to the trigger in the direction of the reset position is described. This concept, however, applies said spring bias to the trigger throughout the process of firing the firearm. As a result the users finger must apply additional force to the trigger in order to move the trigger from the reset position to the firing position. This additional force which the user must apply is equal to the added spring bias towards the reset position applied to the trigger. Thus, once the trigger is moved to the firing position, the user is still required to reduce the force applied to the trigger with his or her finger in order to fire the firearm again. As a result this concept does not resolve the disadvantages of semi-automatic fire control groups known to the art.

With these facts identified it is clear that fire control groups known to the art have many disadvantages. In order that self-loading firearms be equipped with a fire control group which eliminates these disadvantages, a new type of fire control group is needed. Despite this need, the state of the art does not allow for a fire control group which resolves these disadvantages, and therefore is greatly lacking.

BRIEF SUMMARY OF THE INVENTION

The present invention was developed in response to the present state of the art, and in particular, in response to the problems and needs in the state the art that have not yet been fully solved by fire control group instruments and methods currently available. In accordance with the present invention as embodied and broadly described herein in the embodiments, a new type of firearm fire control group is provided. The present invention is the long awaited solution to many of the inherent problems and difficulties in the rapid firing of self-loading firearms.

In its exemplary embodiments, the present invention may be described as a fire control group for firearms essentially conforming to semi-automatic fire control groups known to the art with the addition of novel features, as described herein, which temporarily transfer hammer spring force to the trigger after the firearm has fired live ammunition. This temporary transfer of hammer spring force to the trigger is such that the trigger is urged towards its reset position by force from the hammer spring. This temporary surge in the urging of the trigger towards its reset position may return the trigger to its reset position without requiring the user to reduce the force which was applied to the trigger by the users finger in order to fire the firearm. This return of the trigger to its reset position without the user reducing force applied to the trigger can enable easier, faster and more controllable rapid firing of the firearm when compared to fire control groups known to the art.

In its exemplary embodiments, the present invention has a number of advantages when compared to fire control groups with semi-automatic firing modes in the state of the art. These advantages include but are not limited to:

a) The present invention allows for firing multiple live ammunition cartridges without requiring the user to both increase and also decrease the force applied to the trigger with the users finger. This decreases the time required for the user to prepare the firearm for subsequent firings as well as significantly increases the maximum potential rate of fire.

b) The present invention does not require repeated alternation between contraction and relaxation of the muscles in the users finger for multiple firings to occur. This avoids the associated problems found in the state of the art, including physical taxation, potential of cramping, and the risk of exhausting the ability of the users finger to pull the trigger at the desired rate of fire.

c) The present invention eliminates the time consumed by the requirement in the state of the art for the user to reduce force applied to the trigger after firing a life ammunition cartridge in order for the next live ammunition cartridge to be fired. This greatly reduces the excess delay which exists in the state of the art after the user has aimed the firearm in the process of firing an additional live ammunition cartridge.

d) The present invention allows for reduction in the trigger spring strength required to bias the trigger towards its reset position. This allows for the desirable trait of a lighter trigger pull.

Further, in its exemplary embodiments, the present invention has a number of advantages when compared to fire control groups with both semi-automatic and fully-automatic firing modes in the state of the art. These advantages include but are not limited to:

a) The present invention eliminates the requirement that a selector switch be manipulated by the user in order for the user to change between a low rate of fire and a high rate of fire. This saves time and reduces the burden on the firearm user.

b) The present invention allows for a self-loading firearm with both a low rate of fire and a high rate of fire without requiring additional parts and complexity when compared to firearms which incorporate only a semi-automatic firing mode as known to the art. Therefore the present invention allows for a firearm with a high rate of fire without burdening manufacturing, increasing cost or reducing reliability.

c) The present invention allows for the user to adjust the rate of fire of the firearm during the process of firing the firearm by adjusting the rearward force applied to the trigger. This would allow the user to adjust the rate of fire based on the needs of the user.

d) The present invention allows for a rate of fire that is lower than the cyclic rate of the fully-automatic firearms. This reduces the problems of excessive recoil and excessive ammunition consumption which are commonly associated with the fully-automatic firing mode as known to the art.

e) The present invention allows for a fire control group which may be configured such that excessive force applied to the trigger by the users finger during stress induced clinching of the hand will not repeatedly fire the firearm at a high rate of fire.

Furthermore, the present invention also has advantages when compared to fully-automatic firearms equipped with a rate-reducer as known to the art, including but not limited to:

a) The present invention provides for a firearm which is capable of a high rate of fire which is greater than the rate of fire of typical semi-automatic firing modes as known the art, yet less than the rate of fire of typical fully-automatic firing modes as known to the art. This is seen by many in the art as ideal. The present invention is capable of providing said rate of fire without requiring the additional parts and complexity of a rate-reducer as known to the art. This provides the benefits of a state of the art rate reducer without the increased burden on manufacturing, increased cost and reliability problems which are associated with the complexity of a rate-reducer as known to the art.

BRIEF DESCRIPTION OF DRAWINGS

In order that the manner in which the above-recited and other features and advantages of the present invention are obtained will be readily understood, a greater particular description of the present invention briefly described above will be rendered by reference to specific embodiments thereof which are illustrated in the appended drawings. Understanding that these drawings depict only typical embodiments of the present invention and are not therefore to be considered to be limiting of its scope, the present invention will be described and explained with additional specificity and detail through the use of the accompanying drawings in which:

FIG. 4 depicts the rapid reset fire control 1 of FIG. 3 installed within the lower receiver assembly 4 of the firearm 2. The firearm 2 of FIG. 4 is illustrative of one type of firearm which is known to the art.

FIG. 5 depicts the rapid reset fire control 1 of FIG. 3 installed within the lower receiver assembly 4 of the firearm 2.

FIG. 6 depicts the rapid reset fire control 1 installed within the lower receiver assembly 4 of the firearm 2. FIG. 6 depicts the firearm 2 in its ready to fire condition.

FIG. 7 depicts the rapid reset fire control 1 installed within the lower receiver assembly 4 of the firearm 2. FIG. 7 depicts the first firing of the firearm 2 utilizing the rapid reset fire control 1.

FIG. 8 depicts the rapid reset fire control 1 installed within the lower receiver assembly 4 of the firearm 2. FIG. 8 depicts the cycling of the firearm 2 action by the operating system of the firearm 2.

FIG. 9 depicts the rapid reset fire control 1 installed within the lower receiver assembly 4 of the firearm 2. FIG. 9 depicts the cycling of the firearm 2 action by the operating system of the firearm 2.

FIG. 10 depicts the rapid reset fire control 1 installed within the lower receiver assembly 4 of the firearm 2. FIG. 10 depicts the cycling of the firearm 2 action by the operating system of the firearm 2.

FIG. 11 depicts the rapid reset fire control 1 installed within the lower receiver assembly 4 of the firearm 2. FIG. 11 depicts the cycling of the firearm 2 action by the operating system of the firearm 2.

FIG. 13 depicts the rapid reset fire control 1 installed within the lower receiver assembly 4 of the firearm 2. FIG. 13 depicts the cycling of the firearm 2 action by the operating system of the firearm 2.

FIG. 15 depicts the rapid reset fire control 1 installed within the lower receiver assembly 4 of the firearm 2. FIG. 15 depicts the return of firearm 2 to its ready to fire condition.

FIG. 16 depicts the rapid reset fire control 1 installed within the lower receiver assembly 4 of the firearm 2. FIG. 16 depicts the second firing of the firearm 2 utilizing the rapid reset fire control 1.

REFERENCE NUMERALS

1 Rapid reset fire control.
2 Firearm.
3 Upper receiver assembly.
4 Lower receiver assembly.
5 Bolt carrier assembly.
6 Magazine assembly.
7 Upper portion of firearm.
8 Lower portion of firearm.
9 Forward portion of firearm.

10 Rearward portion of firearm.
11 Bolt carrier surface.
12 Trigger pin.
13 Hammer pin.
14 Trigger assembly.
15 Hammer assembly.
16 Trigger spring.
17 Hammer spring.
18 Trigger sear.
19 Hammer sear.
20 Trigger interface.
21 Striking surface.
22 cam member.
23 cam member spring.
24 cam member pin.
25 cam member hole.
26 cam member pin hole.
27 cam member support.
28 Hammer surface.
29 Clockwise direction.
30 Counter-clockwise direction.
31 Forward direction.
32 Rearward direction.
33 Upward direction.
34 Downward direction.
35 Trigger body.
36 Hammer body.
37 Counteracting force.
38 Pivot pin.
39 Trigger surface.
41 Second surface.
42 Finger.
43 Firing pin.
44 Live ammunition cartridge.
45 Firing chamber.
46 First surface.
47 Rearward force.
48 Bolt assembly.
49 Forward portion of magazine well.
50 Safety selector.
51 Hand grip.
52 Right side of the upper receiver assembly.
53 Right side of the lower receiver assembly.
54 Right side of the bolt carrier assembly.
55 Trigger pin hole.
56 Hammer pin hole.
57 Action spring.
58 Angle of the second surface.
59 Path of travel of the hammer surface.
63 Path of travel of the hammer sear.
64 Certain length.
65 Trigger well.
66 Forward portion of trigger well.
67 Rearward portion of trigger well.
69 Second embodiment of the present invention.
70 Third embodiment of the present invention.
71 Fourth embodiment of the present invention.
73 Second embodiment of the trigger body.
74 Third embodiment of the trigger body.
75 Fourth embodiment of the trigger body.
77 Second embodiment of the hammer body.
78 Third embodiment of the hammer body.
79 Fourth embodiment of the hammer body.
81 Second embodiment of the cam member.
82 Second embodiment of the first surface.
83 Second embodiment of the second surface.
89 Second embodiment of the trigger sear.
90 Second embodiment of the hammer sear.

DETAILED DESCRIPTION OF DRAWINGS

The presently exemplary embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following greater detailed description of the embodiments of the apparatus, system, and method of the present invention, as represented in FIG. 1 through FIG. 19, is not intended to limit the scope of the present invention, as claimed, but is merely representative of presently exemplary embodiments of the present invention.

Figure 1:
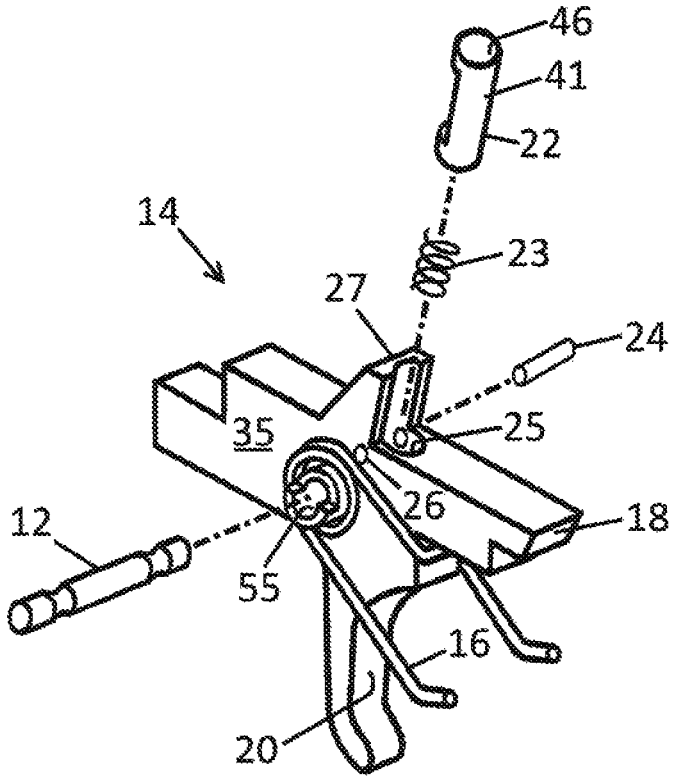
FIG. 1 is an exploded view of one embodiment of the trigger assembly 14.

FIG. 1 is an exploded view of one embodiment of the trigger assembly 14. The trigger assembly 14 of FIG. 1 comprises a trigger body 35, a user interface 20, a cam member 22, a first surface 46, a second surface 41, a cam member spring 23, a cam member pin 24, a cam member hole 25, a cam member pin hole 26, a trigger spring 16, a trigger sear 18, a cam member support 27, a trigger pin hole 55 and a trigger pin 12. The trigger spring 16 is depicted as attached to the trigger body 35 so that it may be illustrated with greater clarity. In this embodiment of the trigger assembly 14 the user interface 20, the trigger spring 16, the trigger sear 18, the trigger pin hole 55 and the trigger pin 12 are essentially of the type found on the AR-15 type firearm and its derivatives.

The trigger pin 12 may be placed through the trigger pin hole 55 such that the trigger body 35 may pivot about the axis of the trigger pin 12. In this configuration the user interface 20, the cam member 22, the first surface 46, the second surface 41, the cam member spring 23, the cam member pin 24, the cam member hole 25, the cam member pin hole 26, the trigger sear 18 and the cam member support 27 pivot together with the trigger body 35 about the axis of the trigger pin 12. The incorporation of the cam member 22, the cam member spring 23, the cam member pin 24, the cam member hole 25, the cam member pin hole 26 and the cam member support 27 unto the trigger body 35 allow the trigger assembly 14 to properly engage with the hammer assembly 15 of FIG. 2.

Additional embodiments of the trigger assembly 14 are possible which essentially conform to alternative trigger configurations as known to the art which differ in arrangement, geometry, dimensions and operation.

Figure 2:
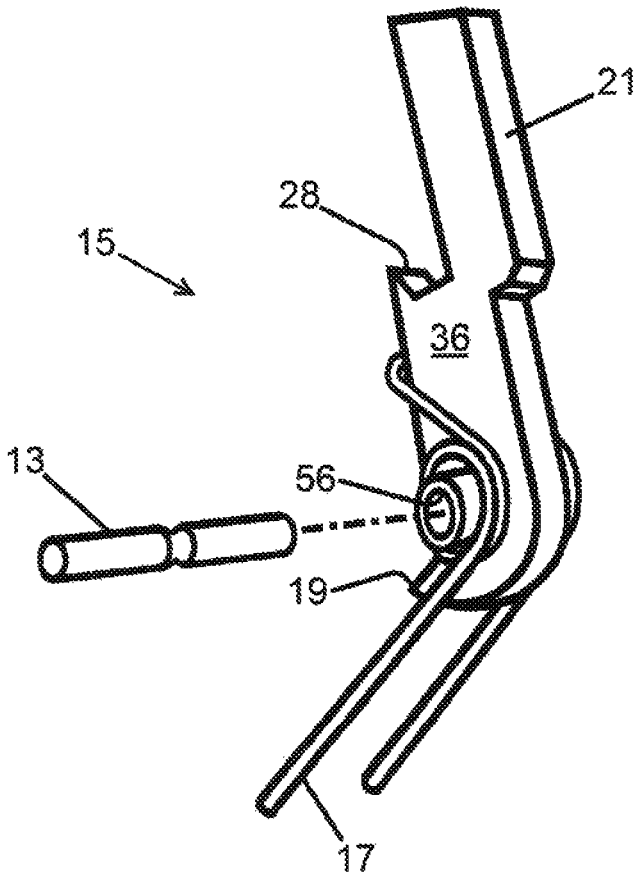
FIG. 2 is an exploded view of one embodiment of the hammer assembly 15.

FIG. 2 is an exploded view of one embodiment of the hammer assembly 15. The hammer assembly 15 of FIG. 2 comprises a hammer body 36, a striking surface 21, a hammer surface 28, a hammer pin 13, a hammer pin hole 56, a hammer sear 19 and a hammer spring 17. The hammer spring 17 is depicted attached to the hammer body 36 so that it may be illustrated with greater clarity. In this embodiment of the hammer assembly 15 the hammer body 36, the striking surface 21, the hammer surface 28, the hammer pin 13, the hammer pin hole 56, the hammer sear 19 and the hammer spring 17 are essentially of the type found on the AR-15 type firearm and its derivatives.

The hammer pin 13 may be placed through the hammer pin hole 56 such that the hammer body 36 may pivot about the axis of the hammer pin 13. In this configuration the striking surface 21, the hammer surface 28 and the hammer sear 19 pivot together with the hammer body 36 about the axis of the hammer pin 13.

Additional embodiments of the hammer assembly 15 are possible which essentially conform to alternative hammer configurations as known to the art which differ in arrangement, geometry, dimensions and operation.

Figure 3:
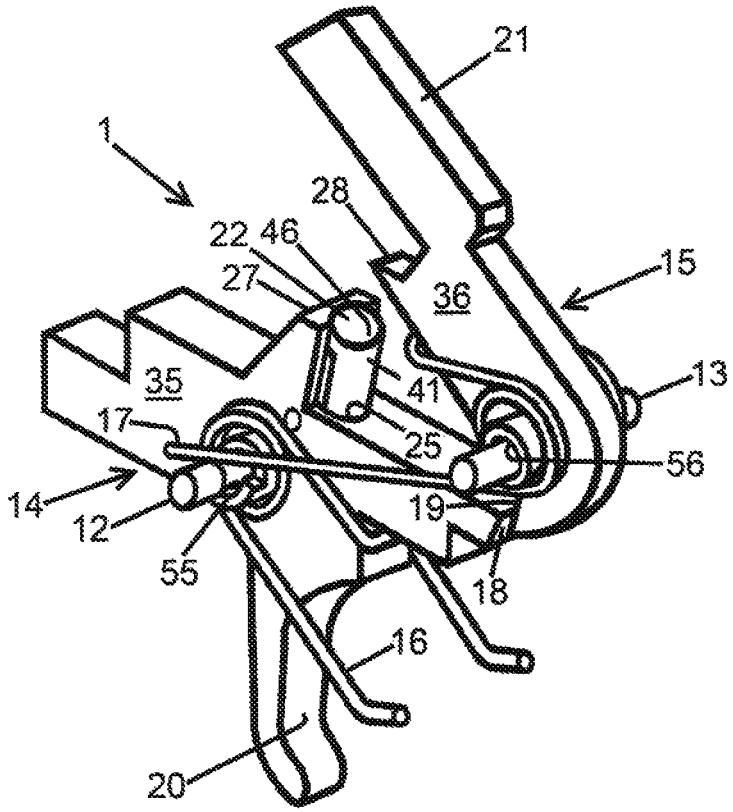
FIG. 3 is a perspective view of one embodiment of the rapid reset fire control 1. The rapid reset fire control 1 of FIG. 3 is an embodiment of the present invention. The rapid reset fire control 1 of FIG. 3 comprises the trigger assembly 14 of FIG. 1 and the hammer assembly 15 of FIG. 2.

FIG. 3 is a perspective view of one embodiment of the rapid reset fire control 1. The rapid reset fire control 1 of FIG. 3 is an embodiment of the present invention. The rapid reset fire control 1 of FIG. 3 comprises the trigger assembly 14 of FIG. 1 and the hammer assembly 15 of FIG. 2. FIG. 3 depicts the trigger assembly 14 and the hammer assembly 15 in their assembled states. FIG. 3 depicts the trigger assembly 14 and the hammer assembly 15 engaging with one another such that the rapid reset fire control 1 has achieved its reset condition. As further illustrated in the subsequent figures, this reset condition of the rapid reset fire control 1 is such that the trigger sear 18 engages the hammer sear 19. As further illustrated in the subsequent figures, the rapid reset fire control 1 engages with the firearm 2 of FIG. 4 in a manner such that the functions of the present invention may be performed.

While the embodiment of the present invention which is depicted in FIG. 3 may bare certain similarities to state of the art fire control groups utilized on the AR-15 type firearm and its derivatives, additional embodiments of the present invention are possible which essentially conform to alternative fire control group configurations as known to the art which differ in arrangement, geometry, dimensions and operation.

Figure 4:
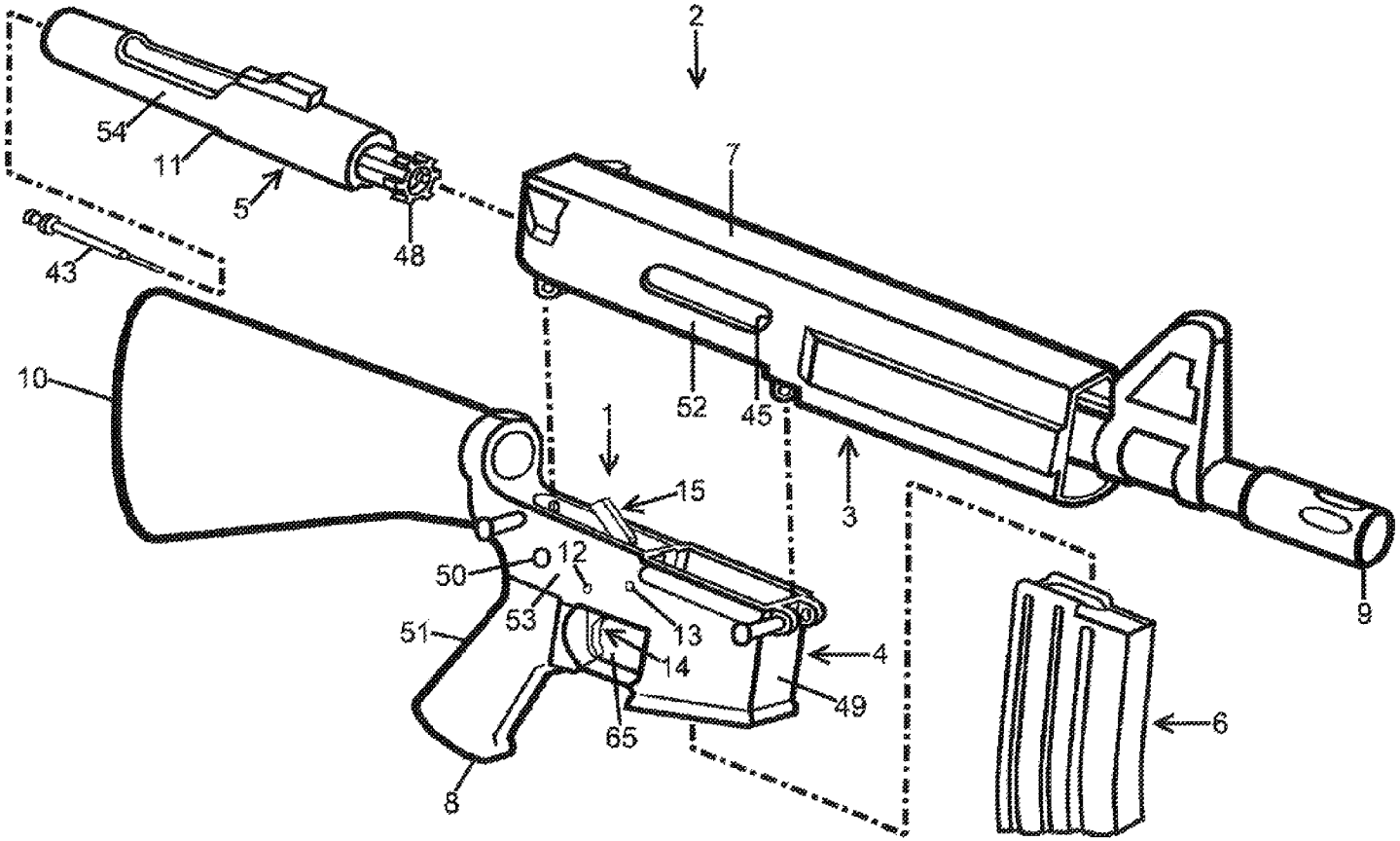
FIG. 4 is an exploded view of a firearm 2.

FIG. 4 is an exploded view of a firearm 2. FIG. 4 depicts the rapid reset fire control 1 of FIG. 3 installed within the lower receiver assembly 4 of the firearm 2. The firearm 2 of FIG. 4 is illustrative of one type of firearm which is known to the art. The firearm 2 of FIG. 4 comprises a bolt carrier assembly 5, a magazine assembly 6, an upper receiver assembly 3 and a lower receiver assembly 4. The firearm 2 of FIG. 4 having a forward portion 9, a rearward portion 10, an upper portion 7 and a lower portion 8. As further illustrated in the subsequent figures, the rapid reset fire control 1 engages with the firearm 2 of FIG. 4 in a manner such that the functions of the present invention may be performed.

While the firearm 2 of FIG. 4 includes a firearm operating system as known to the art, the particular operating system is not depicted for the sake of simplicity. However, the firearm operating system of the firearm 2 may conform to firearm operating system principles which are well understood in the art. The firearm 2 of FIG. 4 may utilize various types of firearm operating systems which are known to the art, these firearm operating system types include but are not limited to blowback operation, recoil operation, gas operation and other firearm operating systems.

While the rapid reset fire control 1 of FIG. 3 may be utilized with the firearm 2 of FIG. 4 in a manner such that the functions of the present invention may be performed, alternative embodiments of the present invention may be utilized with various firearm types in order that the functions of the present invention may be performed. These various firearm types include but are not limited to handguns, sub-machine guns, shotguns, carbines, rifles, machine guns and many other firearm types which are known to the art.

Figure 5:
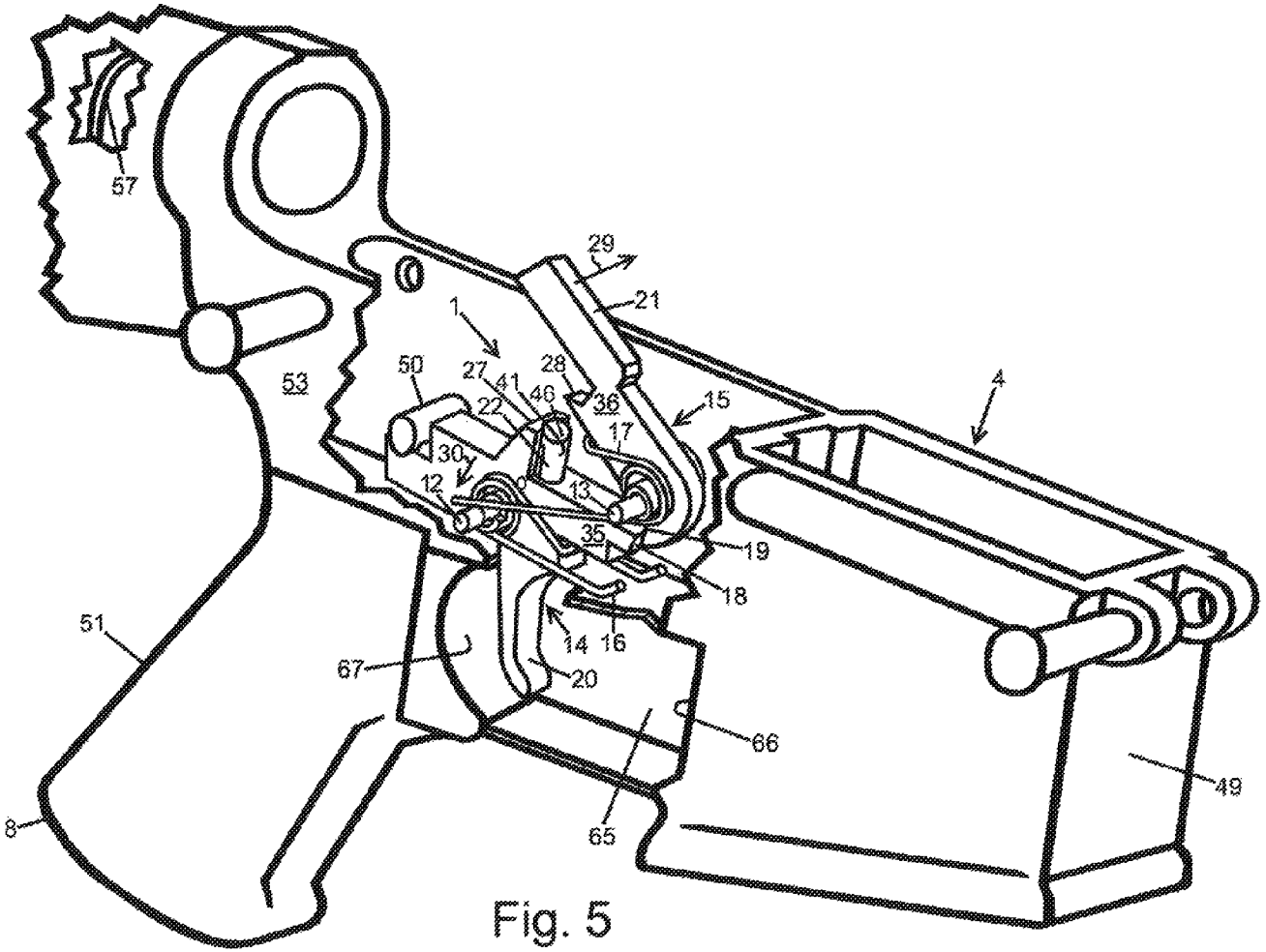
FIG. 5 is a perspective partial sectional view of the lower receiver assembly 4 of the firearm 2.

FIG. 5 is a perspective partial sectional view of the lower receiver assembly 4 of the firearm 2. FIG. 5 depicts the rapid reset fire control 1 of FIG. 3 installed within the lower receiver assembly 4 of the firearm 2. As known to the art, the trigger assembly 14 of FIG. 1 is installed within the lower receiver assembly 4 upon the trigger pin 12 and the hammer assembly 15 of FIG. 2 is installed within the lower receiver assembly 4 upon the hammer pin 13.

The trigger body 35, as well as its associated features, may pivot about the axis of the trigger pin 12. The associated features of the trigger body 35 comprise the cam member 22, the cam member spring 23, the cam member pin 24, the cam member support 27, the cam member hole 25, the cam member pin hole 26, the trigger sear 18 and the trigger interface 20.

The hammer body 36, as well as its associated features, may pivot about the axis of the hammer pin 13. The associated features of the hammer body 36 comprise the striking surface 21, the hammer surface 28 and the hammer sear 19.

As is known to the art the trigger spring 16 engages with the lower receiver assembly 4 such that the trigger body 35, as well as its associated features, are urged in the counterclockwise direction 30 about the axis of the trigger pin 12. Similarly, the hammer spring 17 engages with the trigger pin 12 such that the hammer body 36, as well as its associated features, are urged in the clockwise direction 29 about the axis of the hammer pin 13.

As illustrated in FIG. 5, the trigger body 35 may engage with the safety selector 50 in a manner such that safety selector functions, as known to the art, may be performed.

Figure 6:
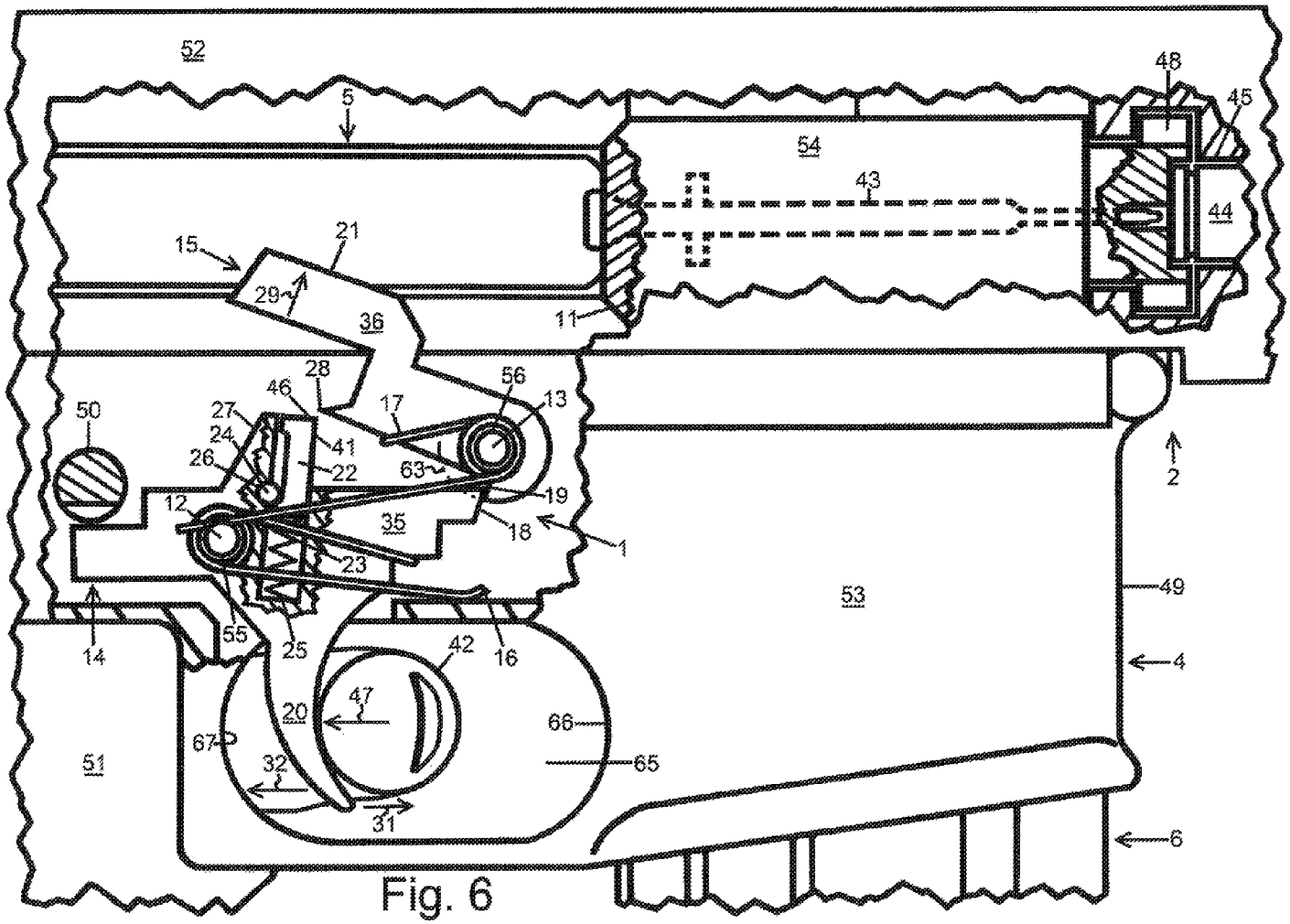
FIG. 6 is a right side partial sectional view of the firearm 2 and the rapid reset fire control 1.
Figure 7:
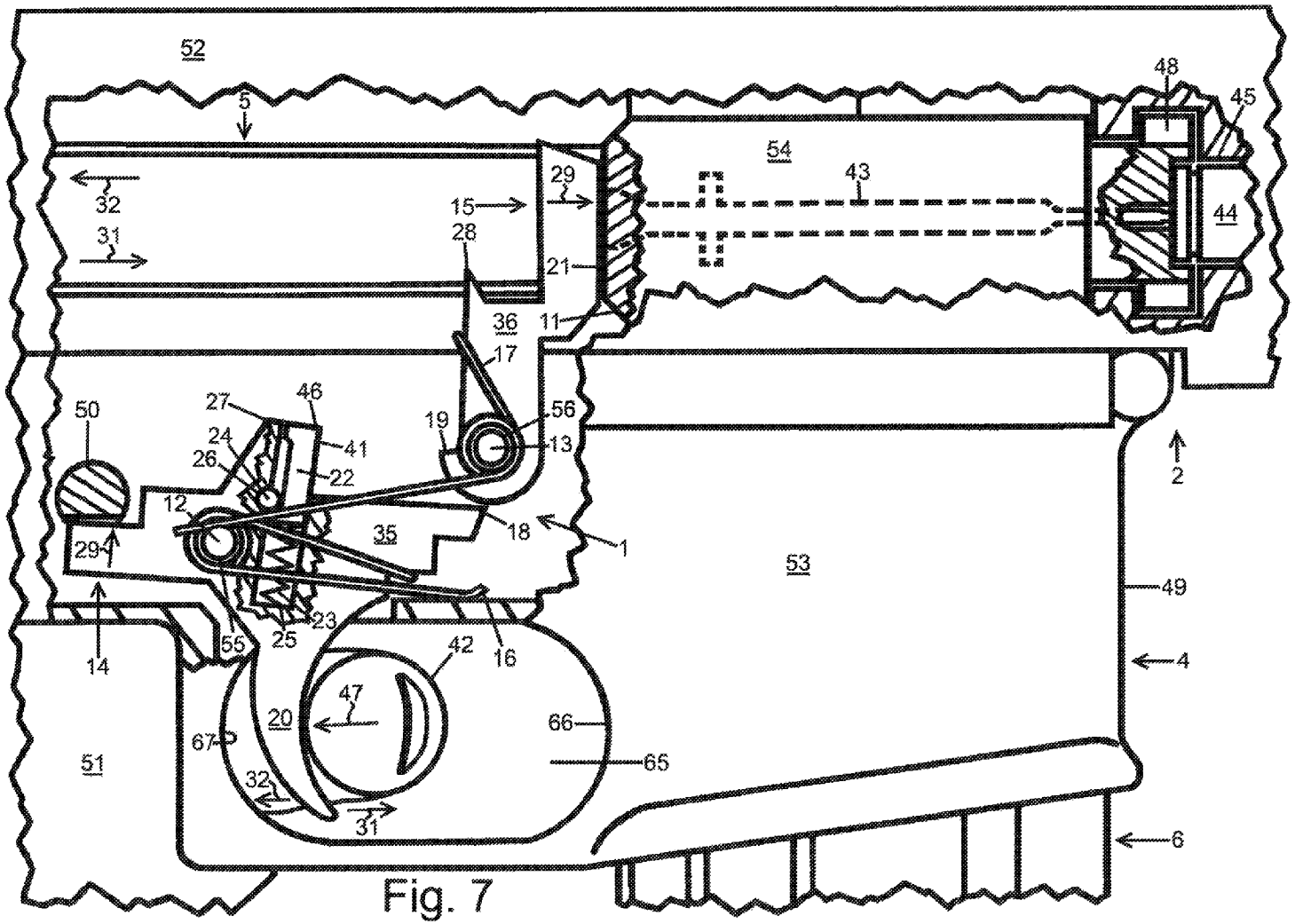
FIG. 7 is a right side partial sectional view of the firearm 2 and the rapid reset fire control 1.
Figure 15:
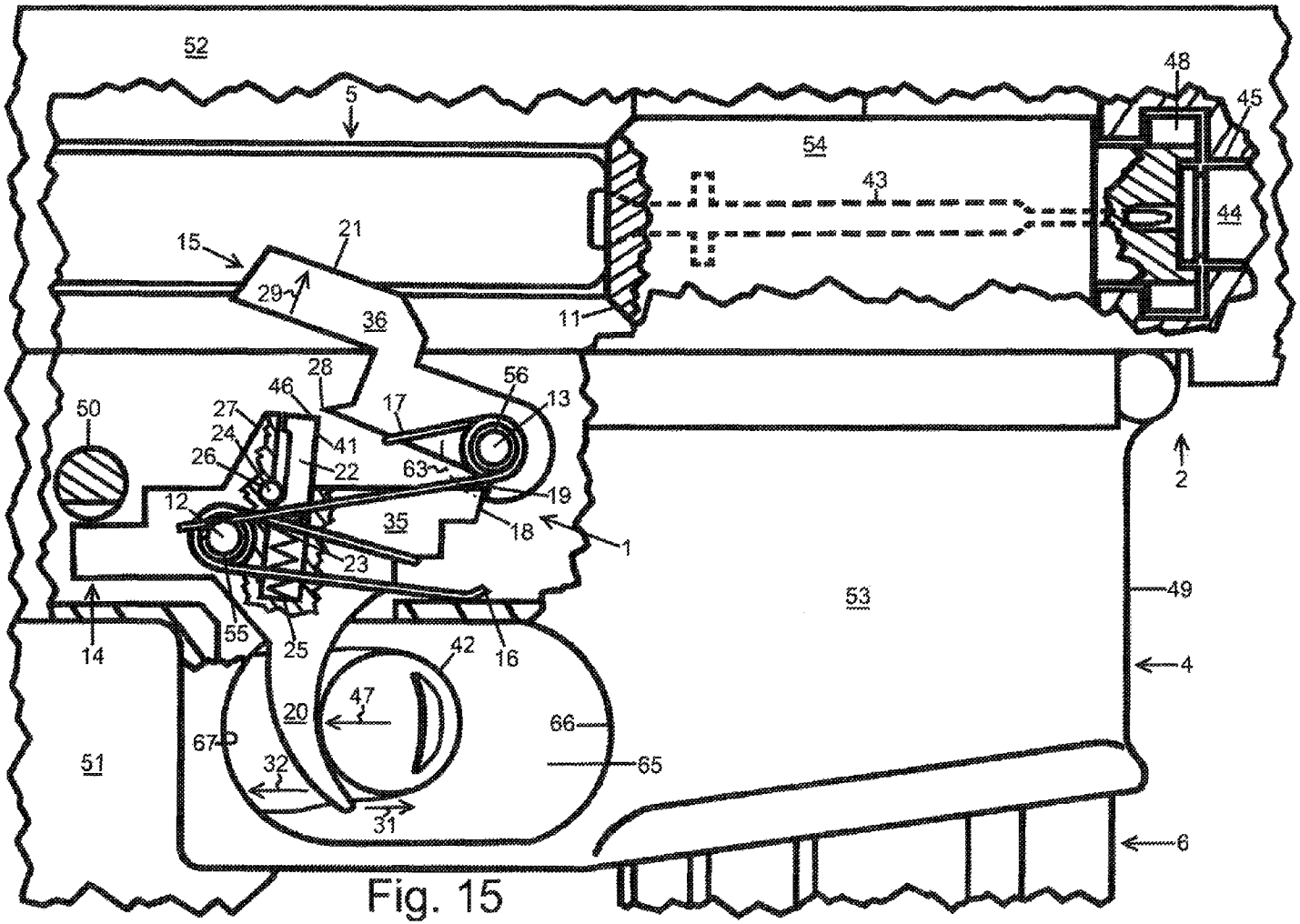
FIG. 15 is a right side partial sectional view of the firearm 2 and the rapid reset fire control 1.
Figure 16:
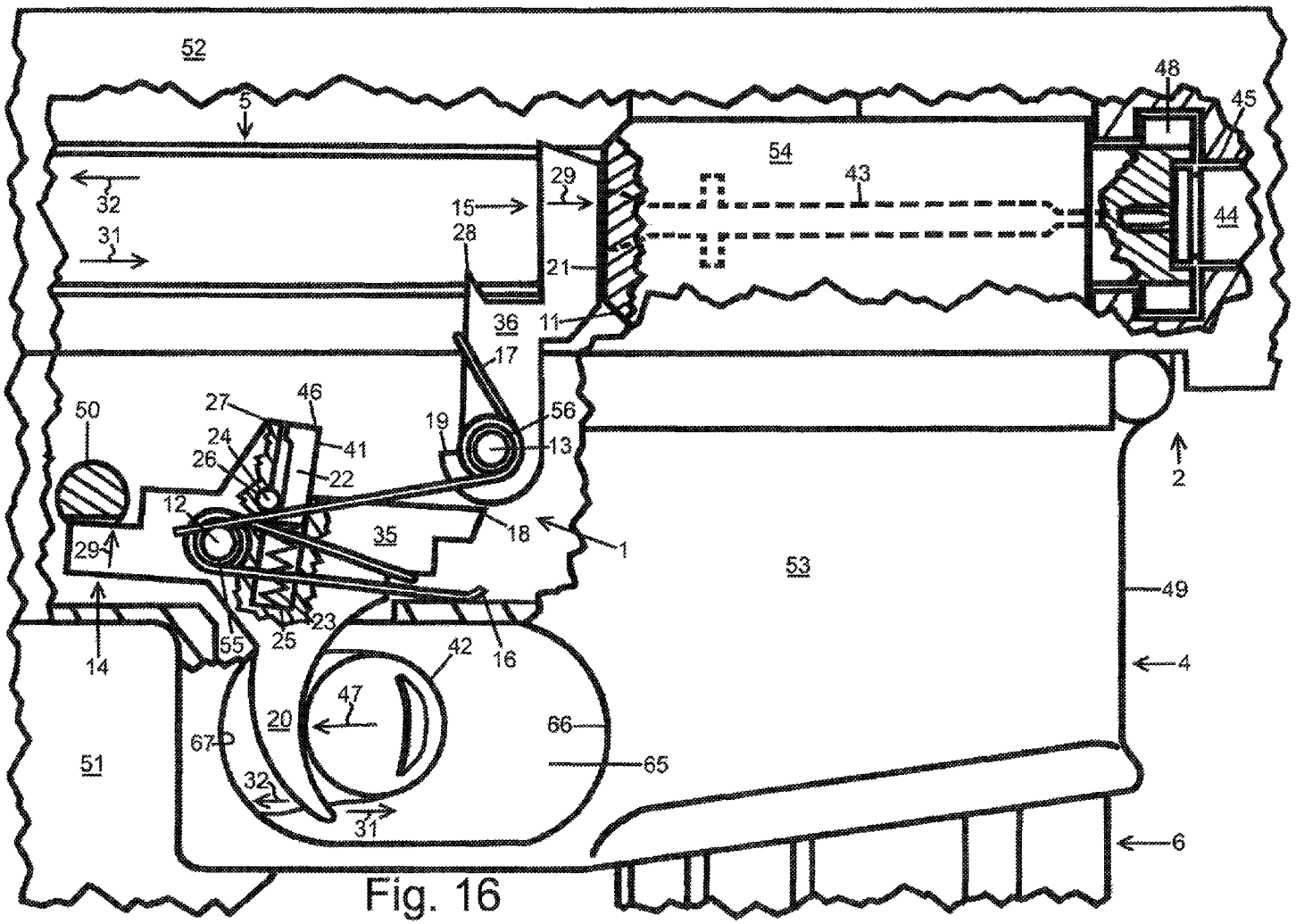
FIG. 16 is a right side partial sectional view of the firearm 2 and the rapid reset fire control 1.

FIG. 6 is a right side partial sectional view of the firearm 2 and the rapid reset fire control 1. FIG. 6 depicts the rapid reset fire control 1 installed within the lower receiver assembly 4 of the firearm 2. Portions of the right side of the upper receiver assembly 52, right side of the lower receiver assembly 53 and right side of the bolt carrier assembly 54 are not depicted so that conditions within the firearm 2 may be illustrated with greater clarity. FIG. 6 through FIG. 16 depict, in sequence, the conditions within the firearm 2 as the firearm 2 is operated by the user using the rapid reset fire control 1. This sequence includes the first firing of the firearm which is depicted in FIG. 7, the second firing of the firearm which is depicted in FIG. 16 as well as the cycling of the firearm 2 action by the operating system of the firearm 2 which is depicted in FIG. 7 through FIG. 13.

FIG. 6 depicts the rapid reset fire control 1 in its reset condition. As depicted in FIG. 6, this reset condition of the rapid reset fire control 1 is such that the trigger sear 18 engages the hammer sear 19. As known to the art, this engagement between the trigger sear 18 and the hammer sear 19 prevents the hammer body 36 from pivoting about the axis of the hammer pin 13 in the clockwise direction 29. Because engagement between the trigger sear 18 and the hammer sear 19 prevents the hammer body 36 from pivoting about the axis of the hammer pin 13 in the clockwise direction 29, the firearm 2 is prevented from firing the live ammunition cartridge 44 which is present in the firing chamber 45 while the rapid reset fire control 1 is in its reset condition.

FIG. 6 depicts the trigger interface 20 in its reset position. As depicted in FIG. 6, this reset position of the trigger interface 20 is such that the trigger interface 20 is positioned distant from the rearward portion of the trigger well 67 in comparison to the firing position of the trigger interface 20 which is subsequently depicted in FIG. 7. As depicted in FIG. 6, when the rapid reset fire control 1 achieves its reset condition, the trigger interface 20 assumes its reset position.

FIG. 6 depicts the bolt carrier assembly 5 in its in-battery condition. As depicted in FIG. 6, this in-battery condition of the bolt carrier assembly 5 is such that the bolt carrier assembly 5 is proximate to the firing chamber 45. As known to the art, the firearm 2 may function properly if the live ammunition cartridge 44 which is present in the firing chamber 45 is fired by the firearm 2 while the bolt carrier assembly 5 is in its in-battery condition. As known to the art, when the firearm 2 achieves the conditions which are depicted in FIG. 6 the live ammunition cartridge 44 which is present in the firing chamber 45 may be fired by the firearm 2 in a manner such that proper function of the firearm 2 is achieved. Therefore, the firearm 2 of FIG. 6 is in its ready to fire condition.

FIG. 6 depicts the firearm 2 in its ready to fire condition. In order for the user to cause the firearm 2 of FIG. 6 to fire the live ammunition cartridge 44 which is present in the firing chamber 45, the user engages the trigger interface 20 with his or her finger 42 in a manner such that a rearward force 47 is applied unto the trigger interface 20. As subsequently described in FIG. 7, this rearward force 47 which is applied unto the trigger interface 20 causes the trigger interface 20 to be displaced essentially in the rearward direction 32 from its reset position which is currently depicted in FIG. 6 to its firing position which is subsequently depicted in FIG. 7. As described in the figures, this displacement of the trigger interface 20 essentially in the rearward direction 32 causes the trigger sear 18 to be disengaged from the hammer sear 19 in a manner such that the firearm 2 will fire the live ammunition cartridge 44 which is present in the firing chamber 45 as known to the art.

FIG. 7 is a right side partial sectional view of the firearm 2 and the rapid reset fire control 1. FIG. 7 depicts the rapid reset fire control 1 installed within the lower receiver assembly 4 of the firearm 2. Portions of the right side of the upper receiver assembly 52, right side of the lower receiver assembly 53 and right side of the bolt carrier assembly 54 are not depicted so that conditions within the firearm 2 may be illustrated with greater clarity. FIG. 6 through FIG. 16 depict, in sequence, the conditions within the firearm 2 as the firearm 2 is operated by the user using the rapid reset fire control 1. This sequence includes the first firing of the firearm which is depicted in FIG. 7, the second firing of the firearm which is depicted in FIG. 16 as well as the cycling of the firearm 2 action by the operating system of the firearm 2 which is depicted in FIG. 7 through FIG. 13. The conditions which are depicted in FIG. 7 take place in sequence immediately after the conditions which are depicted in FIG. 6.

FIG. 7 depicts the conditions of the firearm 2 and the rapid reset fire control 1 during the first firing of the firearm 2. In order for the user to cause the firearm 2 of FIG. 6 to fire the live ammunition cartridge 44 which is present in the firing chamber 45, the user has engaged the trigger interface 20 with his or her finger 42 in a manner such that a rearward force 47 is applied unto the trigger interface 20.

As depicted in FIG. 7, this rearward force 47 which is applied unto the trigger interface 20 has caused the trigger interface 20 to be displaced essentially in the rearward direction 32 from its reset position which is previously depicted in FIG. 6 to its firing position which is currently depicted in FIG. 7.

Because the trigger interface 20 is an associated feature of the trigger body 35 and therefore moves with the trigger body 35, the aforementioned displacement of the trigger interface 20 in the rearward direction 32 from its previous position which is depicted in FIG. 6 to its current position which is depicted in FIG. 7 has caused the trigger body 35 to pivot about the axis of the trigger pin 12 in the clockwise direction 29 from its previous position which is depicted in FIG. 6 to its current position which is depicted in FIG. 7.

Because the trigger sear 18 is an associated feature of the trigger body 35 and therefore moves with the trigger body 35, the aforementioned pivotal displacement of the trigger body 35 about the axis of the trigger pin 12 in the clockwise direction 29 from its previous position which is depicted in FIG. 6 to its current position which is depicted in FIG. 7 has caused the trigger sear 18 to be pivotally displaced about the axis of the trigger pin 12 in a manner such that the trigger sear 18 disengages from the hammer sear 19.

As described in the figures, this disengagement of the trigger sear 18 from the hammer sear 19 has permitted force from the hammer spring 17 to cause the hammer body 36 to pivot about the axis of the hammer pin 13 in the clockwise direction 29 from its previous position which is depicted in FIG. 6 to its current position which is depicted in FIG. 7.

As described in the figures, this displacement of the hammer body 36 from its previous position which is depicted in FIG. 6 to its current position which is depicted in FIG. 7 has caused the striking surface 21 to engage the firing pin 43. As known to the art, this engagement between the striking surface 21 and the firing pin 43 has caused the firing pin 43 to engage the live ammunition cartridge 44 which is present in the firing chamber 45.

Figure 8:
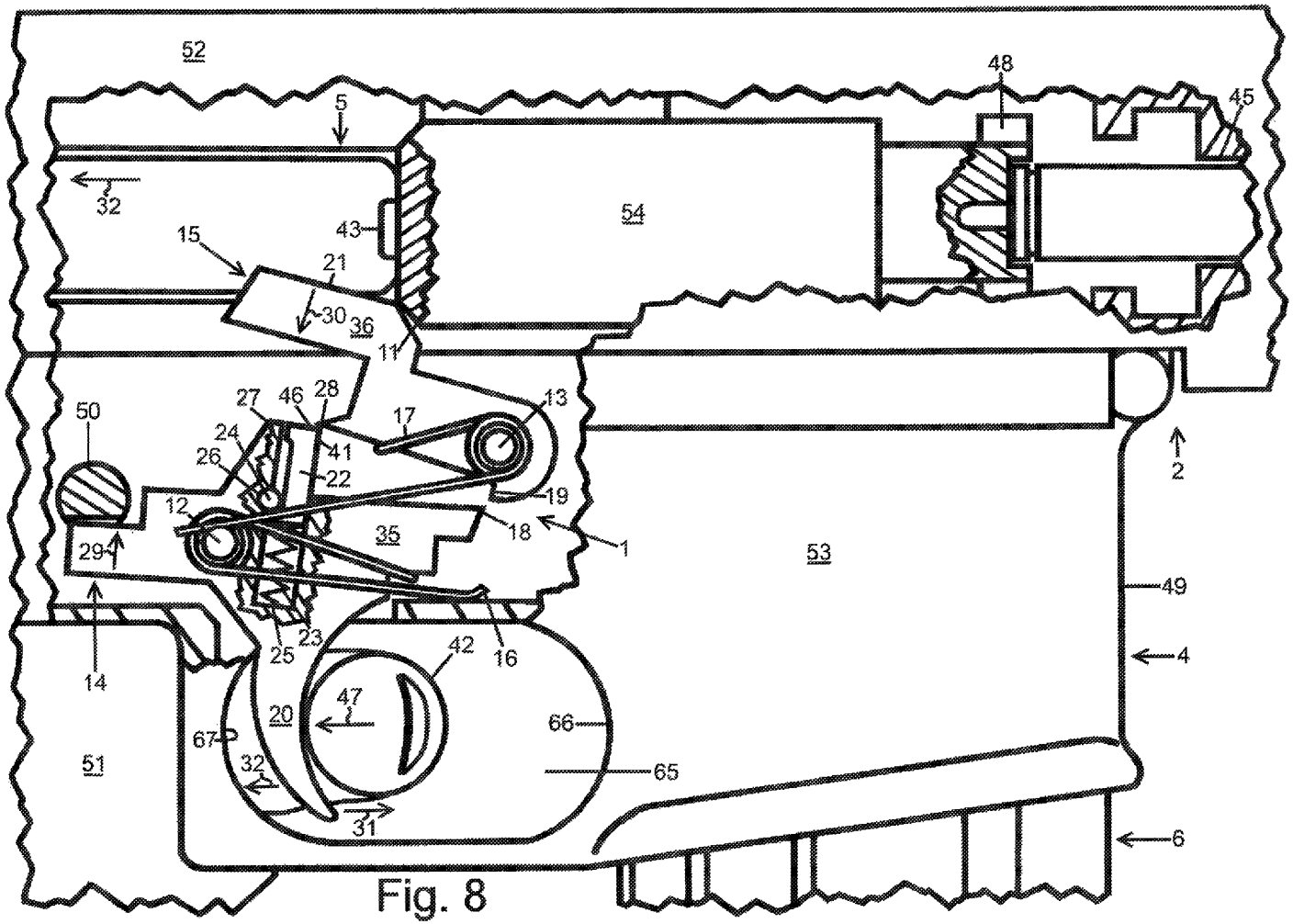
FIG. 8 is a right side partial sectional view of the firearm 2 and the rapid reset fire control 1.
Figure 9:
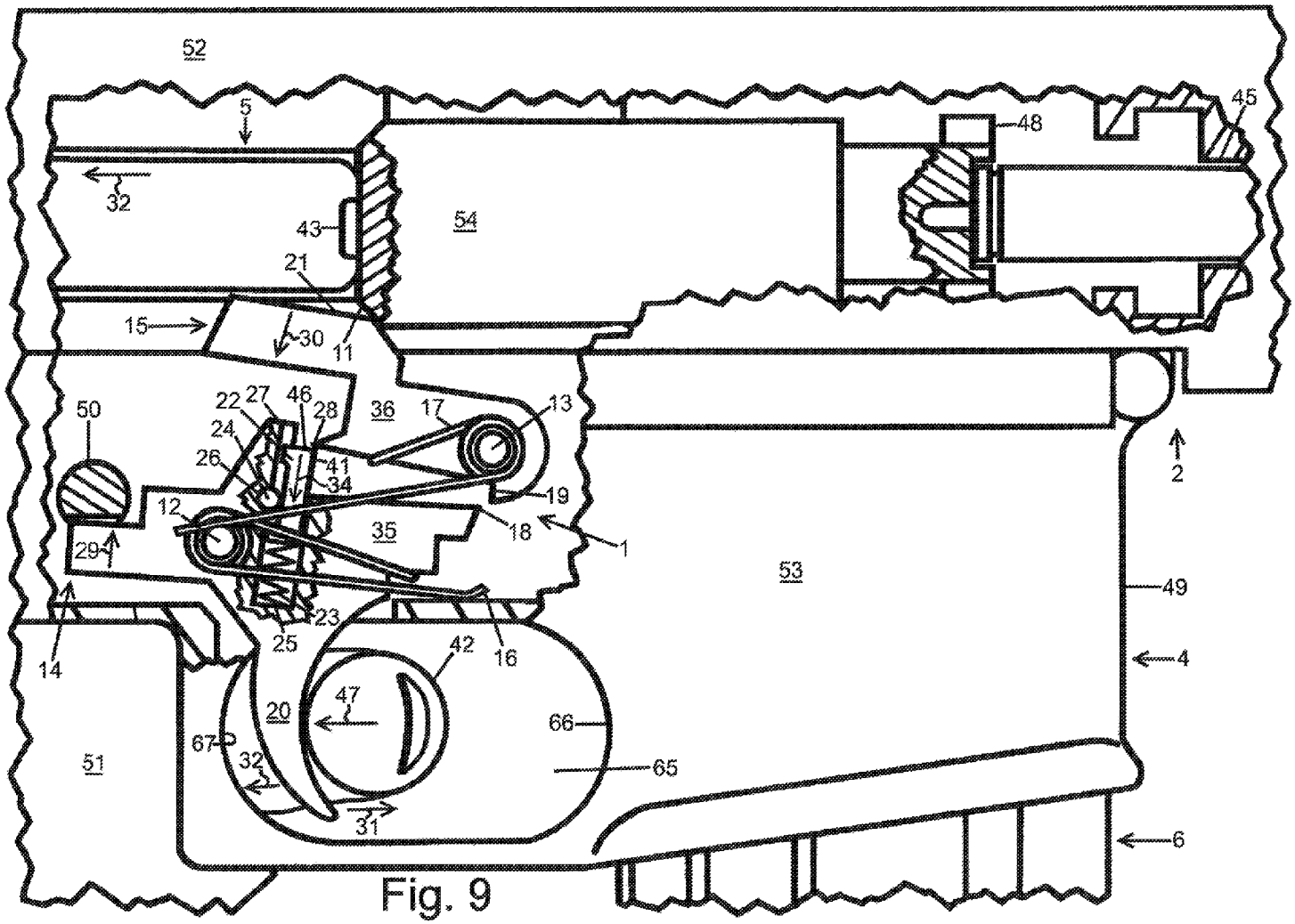
FIG. 9 is a right side partial sectional view of the firearm 2 and the rapid reset fire control 1.
Figure 10:
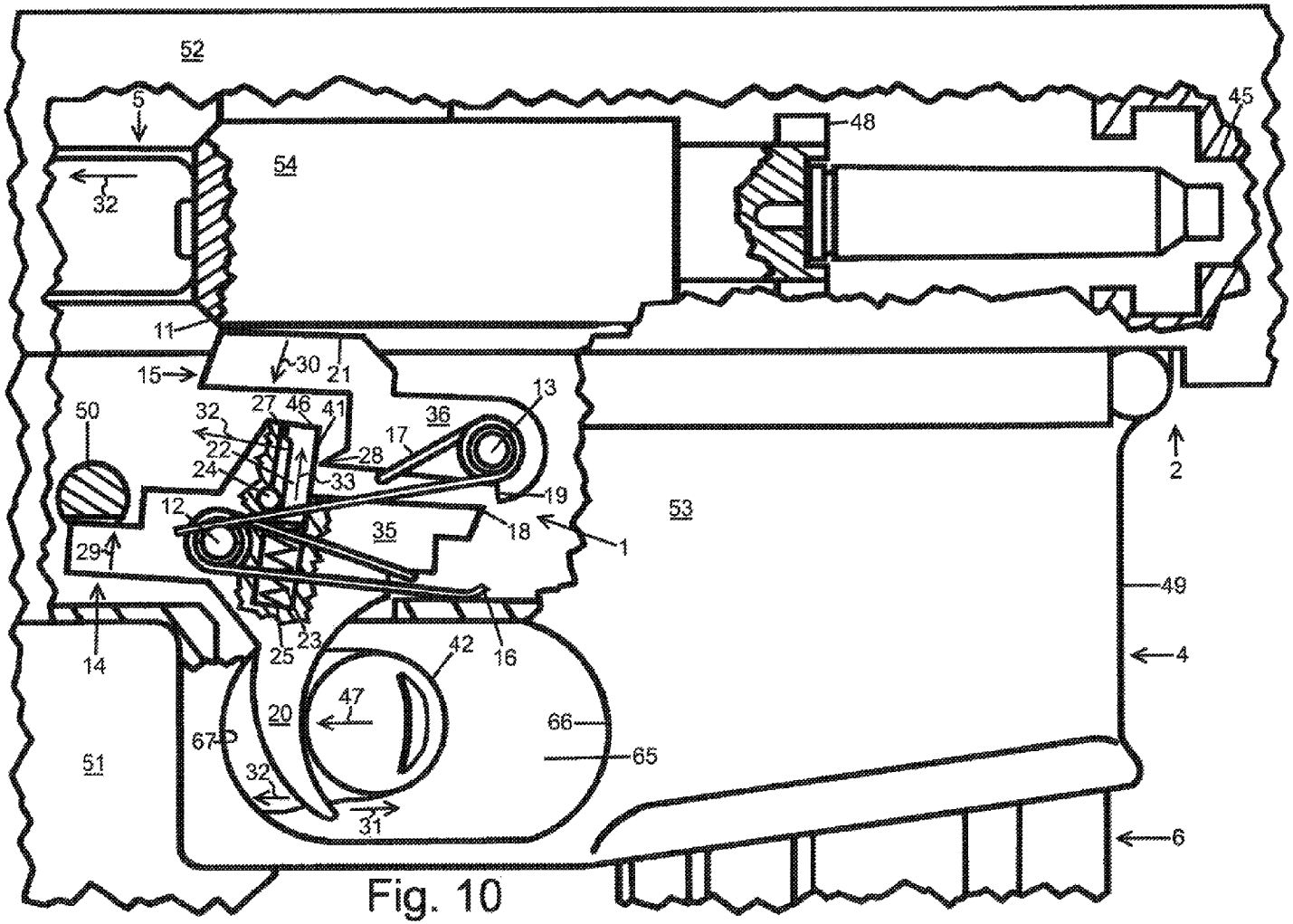
FIG. 10 is a right side partial sectional view of the firearm 2 and the rapid reset fire control 1.
Figure 11:
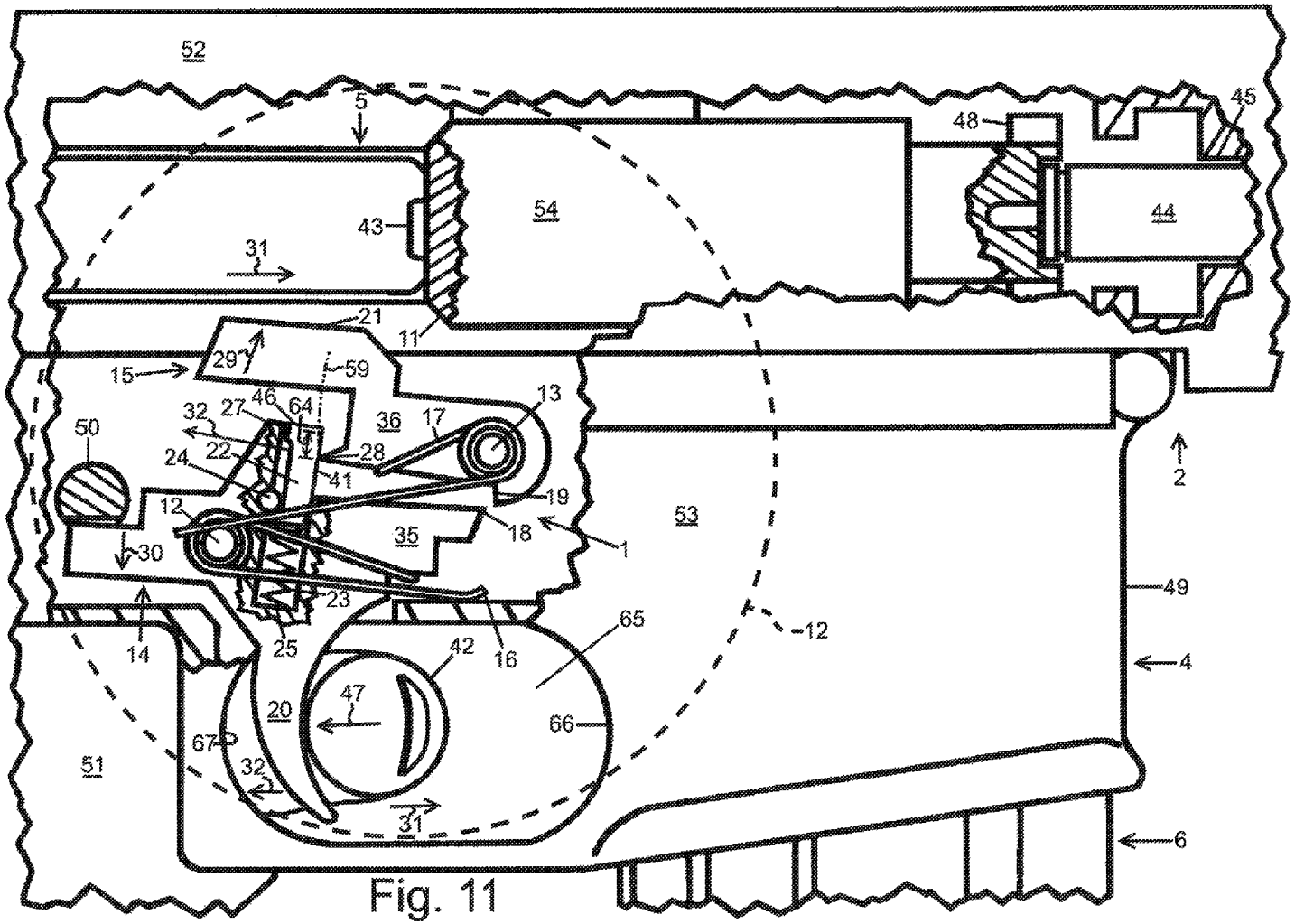
FIG. 11 is a right side partial sectional view of the firearm 2 and the rapid reset fire control 1.
Figure 12:
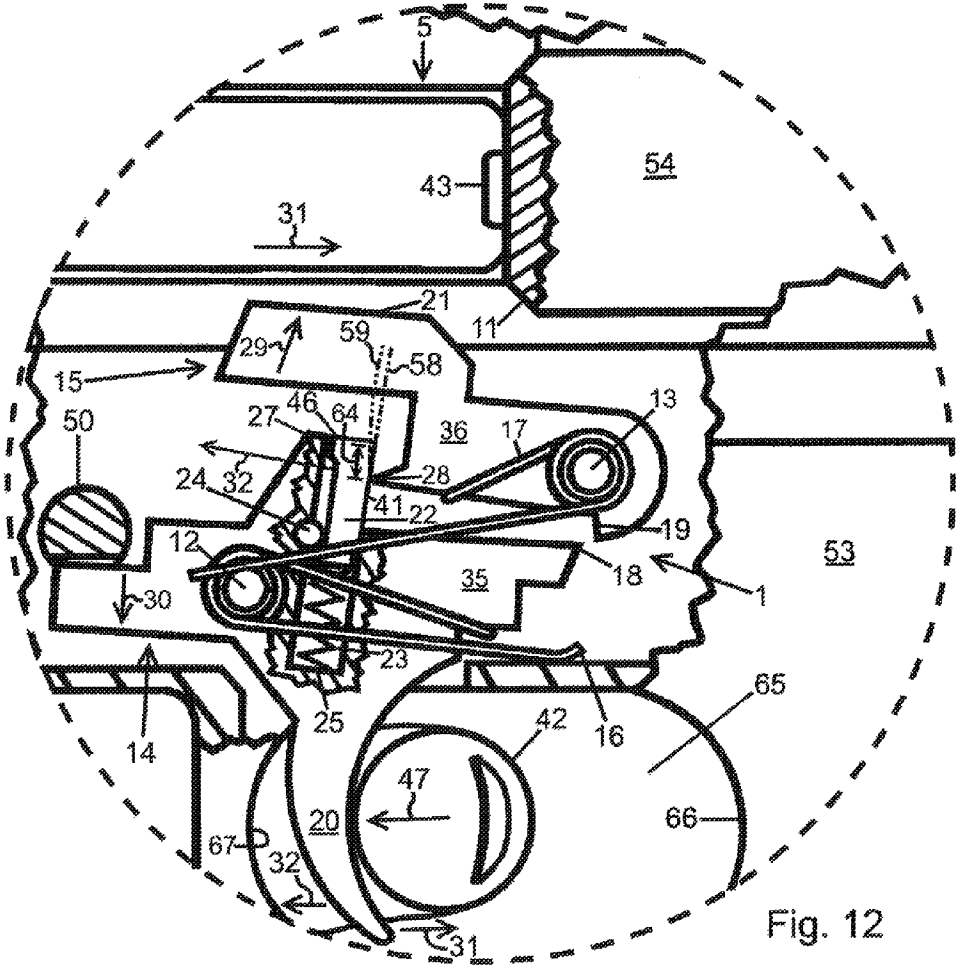
FIG. 12 is an enlarged view depicting a portion of FIG. 11.
Figure 13:
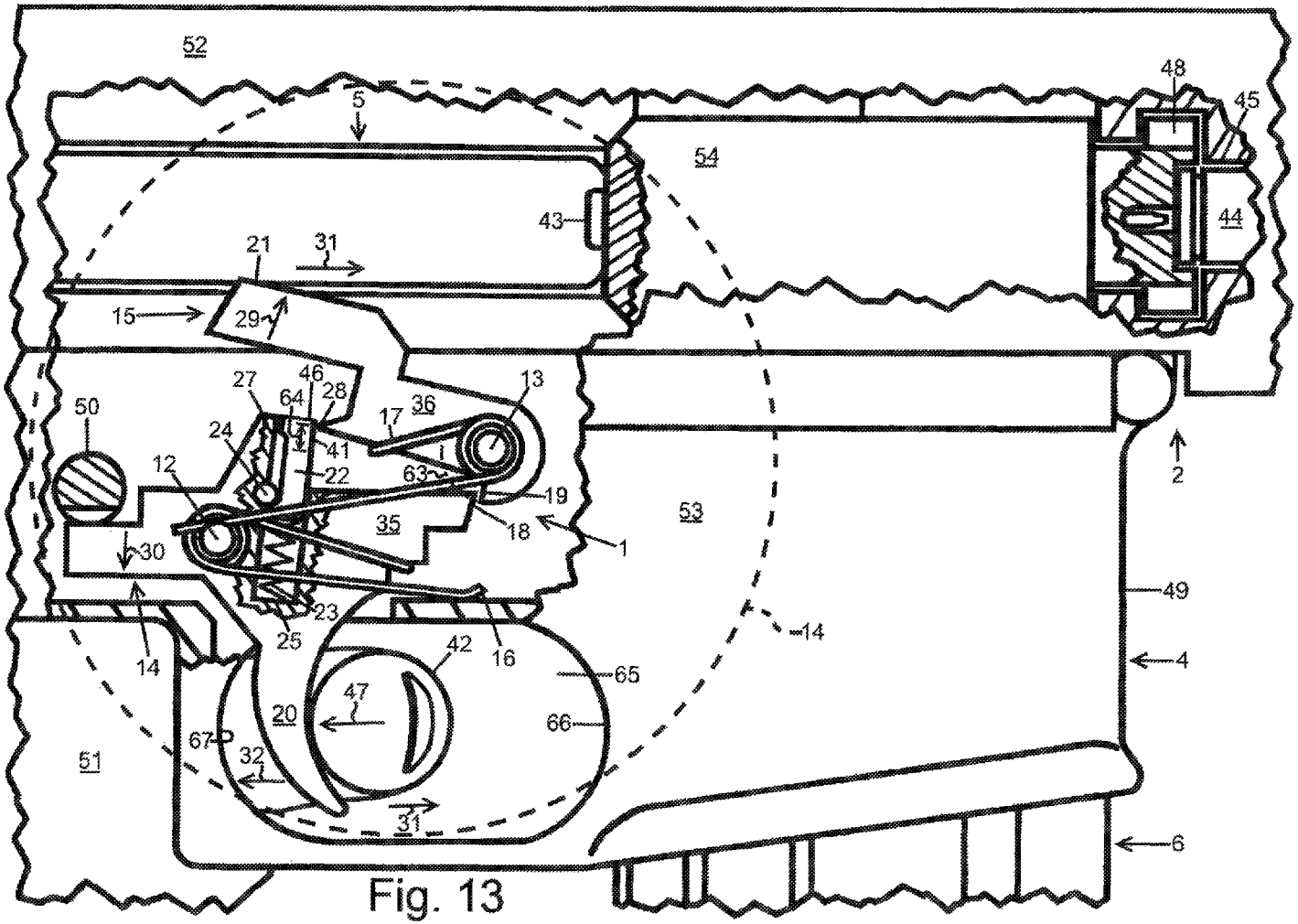
FIG. 13 is a right side partial sectional view of the firearm 2 and the rapid reset fire control 1.

As known to the art, the firing pin 43 has engaged the live ammunition cartridge 44 which is present in the firing chamber 45 in a manner such that the live ammunition cartridge 44 is fired by the firearm 2. This first firing of the firearm 2, which is depicted in FIG. 7, provides impetus to the operating system of the firearm 2 as known to the art. As known to the art, this impetus from the first firing of the firearm 2 causes the bolt carrier assembly 5 to be displaced within the firearm 2 in both the rearward direction 32, as depicted in FIG. 8 through FIG. 10, and then in the forward direction 31, as depicted in FIG. 11 through FIG. 13.

FIG. 7 depicts the trigger interface 20 in its firing position. As depicted in FIG. 7, this firing position of the trigger interface 20 is such that the trigger interface 20 is positioned proximate to the rearward portion of the trigger well 67 in comparison to the reset position of the trigger interface 20 which is depicted in FIG. 6. As depicted in FIG. 7, during the firing of the firearm 2 the trigger interface 20 assumes its firing position.

FIG. 7 depicts the user as continuing to engage the trigger interface 20 with his or her finger 42 in such a manner that essentially the same rearward force 47 is applied unto the trigger interface 20 as was needed to cause the first firing of the firearm 2 to occur.

The user of the firearm 2 with the rapid reset fire control 1 installed may increase or decrease the speed at which, after this first firing of the firearm 2, the rapid reset fire control 1 reattains its reset position, by simply varying the amount of rearward force 47 by which he or she engages the trigger interface. The aforementioned increase or decrease in the speed that the rapid reset fire control 1 reattains its reset position has the effect of allowing the user of the firearm 2 with rapid reset fire control 1 installed to manipulate the rate of fire during firing of the firearm 2.

FIG. 8 is a right side partial sectional view of the firearm 2 and the rapid reset fire control 1. FIG. 8 depicts the rapid reset fire control 1 installed within the lower receiver assembly 4 of the firearm 2. Portions of the right side of the upper receiver assembly 52, right side of the lower receiver assembly 53 and right side of the bolt carrier assembly 54 are not depicted so that conditions within the firearm 2 may be illustrated with greater clarity. FIG. 6 through FIG. 16 depict, in sequence, the conditions within the firearm 2 as the firearm 2 is operated by the user using the rapid reset fire control 1. This sequence includes the first firing of the firearm which is depicted in FIG. 7, the second firing of the firearm which is depicted in FIG. 16 as well as the cycling of the firearm 2 action by the operating system of the firearm 2 which is depicted in FIG. 7 through FIG. 13. The conditions which are depicted in FIG. 8 take place in sequence immediately after the conditions which are depicted in FIG. 7.

FIG. 8 depicts the conditions of the firearm 2 and the rapid reset fire control 1 after the first firing of the firearm 2. This first firing of the firearm 2, which is depicted in FIG. 7, has provided impetus to the operating system of the firearm 2 as known to the art. This impetus from the first firing of the firearm 2 has caused the bolt carrier assembly 5 to be displaced in the rearward direction 32 within the firearm 2 from its previous position which is depicted in FIG. 7 to its current position which is depicted in FIG. 8.

This displacement of the bolt carrier assembly 5 in the rearward direction 32 within the firearm 2 from its previous position which is depicted in FIG. 7 to its current position which is depicted in FIG. 8 has caused the bolt carrier surface 11 to engage the striking surface 21.

Due to the aforementioned engagement between the bolt carrier surface 11 and the striking surface 21, the hammer body 36 has been caused to pivot about the axis of the hammer pin 13 in the counter-clockwise direction 3 from its previous position which is depicted in FIG. 7 to its current position which is depicted in FIG. 8 as the bolt carrier assembly 5 was displaced within the firearm 2 in the rearward direction 32 from its previous position which is depicted in FIG. 7 to its current position which is depicted in FIG. 8.

The aforementioned pivotal displacement of the hammer body 36 in the counter-clockwise direction 30 about the axis of the hammer pin 13 from its previous position which is depicted in FIG. 7 to its current position which is depicted in FIG. 8 has caused the hammer surface 28 to begin engaging the first surface 46 of the cam member 22.

FIG. 8 depicts the user as continuing to engage the trigger interface 20 with his or her finger 42 in such a manner that essentially the same rearward force 47 is applied unto the trigger interface 20 as was needed to cause the first firing of the firearm 2 to occur.

FIG. 9 is a right side partial sectional view of the firearm 2 and the rapid reset fire control 1. FIG. 9 depicts the rapid reset fire control 1 installed within the lower receiver assembly 4 of the firearm 2. Portions of the right side of the upper receiver assembly 52, right side of the lower receiver assembly 53 and right side of the bolt carrier assembly 54 are not depicted so that conditions within the firearm 2 may be illustrated with greater clarity. FIG. 6 through FIG. 16 depict, in sequence, the conditions within the firearm 2 as the firearm 2 is operated by the user using the rapid reset fire control 1. This sequence includes the first firing of the firearm which is depicted in FIG. 7, the second firing of the firearm which is depicted in FIG. 16 as well as the cycling of the firearm 2 action by the operating system of the firearm 2 which is depicted in FIG. 7 through FIG. 13. The conditions which are depicted in FIG. 9 take place in sequence immediately after the conditions which are depicted in FIG. 8.

FIG. 9 depicts the conditions of the firearm 2 and the rapid reset fire control 1 after the first firing of the firearm 2. This first firing of the firearm 2, which is depicted in FIG. 7, has provided impetus to the operating system of the firearm 2 as known to the art. This impetus from the first firing of the firearm 2 has caused the bolt carrier assembly 5 to be displaced in the rearward direction 32 within the firearm 2 from its previous position which is depicted in FIG. 8 to its current position which is depicted in FIG. 9.

This displacement of the bolt carrier assembly 5 in the rearward direction 32 within the firearm 2 from its previous position which is depicted in FIG. 8 to its current position which is depicted in FIG. 9 has caused the bolt carrier surface 11 to further engage the striking surface 21.

Due to the aforementioned engagement between the bolt carrier surface 11 and the striking surface 21, the hammer body 36 has been caused to pivot in the counter-clockwise direction 30 about the axis of the hammer pin 13 from its previous position which is depicted in FIG. 8 to its current position which is depicted in FIG. 9 as the bolt carrier assembly 5 was displaced within the firearm 2 in the rearward direction 32 from its previous position which is depicted in FIG. 8 to its current position which is depicted in FIG. 9.

The aforementioned pivotal displacement of the hammer body 36 in the counter-clockwise direction 30 about the axis of the hammer pin 13 from its previous position which is depicted in FIG. 8 to its current position which is depicted in FIG. 9 has caused the hammer surface 28 to further engage the first surface 46 of the cam member 22. As depicted in FIG. 9, this further engagement between the hammer surface 28 and the first surface 46 of the cam member 22 has caused the cam member 22 to be displaced in the downward direction 34 from its previous position which is depicted in FIG. 8 to its current position which is depicted in FIG. 9. The aforementioned downward displacement of the cam member 22 from its previous position which is depicted in FIG. 8 to its current position which is depicted in FIG. 9 has caused the cam member 22 to be depressed into the cam member hole 25 against the urging of the cam member spring 23.

Due to the aforementioned manner in which the hammer surface 28, first surface 46, cam member 22, cam member spring 23 and trigger body 35 interact, as the cam member 22 is displaced in the downward direction 34 from its previous position which is depicted in FIG. 8 to its current position which is depicted in FIG. 9, the trigger body 35 may be caused to pivot about the axis of the trigger pin 12 in the clockwise direction 29. This pivotal displacement of the trigger body 35 about the axis of the trigger pin 12 in the clockwise direction 29 may have the added benefit of urging the trigger interface 20 to assume its aforementioned firing position immediately after the firing of the firearm regardless of the users manipulation of the trigger interface 20 immediately after firing. Forcing the trigger interface 20 into its firing position immediately after firing may provide the added benefit consistency and ease of use.

FIG. 9 depicts the user as continuing to engage the trigger interface 20 with his or her finger 42 in such a manner that essentially the same rearward force 47 is applied unto the trigger interface 20 as was needed to cause the first firing of the firearm 2 to occur.

FIG. 10 is a right side partial sectional view of the firearm 2 and the rapid reset fire control 1. FIG. 10 depicts the rapid reset fire control 1 installed within the lower receiver assembly 4 of the firearm 2. Portions of the right side of the upper receiver assembly 52, right side of the lower receiver assembly 53 and right side of the bolt carrier assembly 54 are not depicted so that conditions within the firearm 2 may be illustrated with greater clarity. FIG. 6 through FIG. 16 depict, in sequence, the conditions within the firearm 2 as the firearm 2 is operated by the user using the rapid reset fire control 1. This sequence includes the first firing of the firearm which is depicted in FIG. 7, the second firing of the firearm which is depicted in FIG. 16 as well as the cycling of the firearm 2 action by the operating system of the firearm 2 which is depicted in FIG. 7 through FIG. 13. The conditions which are depicted in FIG. 10 take place in sequence immediately after the conditions which are depicted in FIG. 9.

FIG. 10 depicts the conditions of the firearm 2 and the rapid reset fire control 1 after the first firing of the firearm 2. This first firing of the firearm 2, which is depicted in FIG. 7, has provided impetus to the operating system of the firearm 2 as known to the art. This impetus from the first firing of the firearm 2 has caused the bolt carrier assembly 5 to be displaced in the rearward direction 32 within the firearm 2 from its previous position which is depicted in FIG. 9 to its current position which is depicted in FIG. 10.

This displacement of the bolt carrier assembly 5 in the rearward direction 32 within the firearm 2 from its previous position which is depicted in FIG. 9 to its current position which is depicted in FIG. 10 has caused the bolt carrier surface 11 to further engage the striking surface 21.

Due to the aforementioned engagement between the bolt carrier surface 11 and the striking surface 21, the hammer body 36 has been caused to pivot in the counter-clockwise direction 30 about the axis of hammer pin 13 from its previous position which is depicted in FIG. 9 to its current position which is depicted in FIG. 10 as the bolt carrier assembly 5 was displaced within the firearm 2 in the rearward direction 32 from its previous position which is depicted in FIG. 9 to its current position which is depicted in FIG. 10. The aforementioned pivotal displacement of the hammer body 36 in the counter-clockwise direction 30 about the axis of the hammer pin 13 from its previous position which is depicted in FIG. 9 to its current position which is depicted in FIG. 10 has caused the hammer surface 28 to disengage from the first surface 46 of the cam member 22.

As depicted in FIG. 10, this disengagement of the hammer surface 28 from the first surface 46 of the cam member 22 has permitted force from the cam member spring 23 to cause the cam member 22 to be displaced in the upward direction 33 from its previous position which is depicted in FIG. 9 to its current position which is depicted in FIG. 10. As depicted in FIG. 10, the current position of the cam member 22 is such that the cam member 22 engages the cam member pin 24. This engagement between the cam member 22 and the cam member pin 24 is such that further displacement of the cam member 22 in the upward direction 33 is prevented. As depicted in FIG. 10, the current position of the cam member 22 is such that the cam member 22 engages the cam member support 27. This engagement between the cam member 22 and cam member support 27 is such that the cam member 22 is prevented from being displaced essentially in the rearward direction 32 in relation to the position of the cam member support 27.

FIG. 10 depicts the user as continuing to engage the trigger interface 20 with his or her finger 42 in such a manner that essentially the same rearward force 47 is applied unto the trigger interface 20 as was needed to cause the first firing of the firearm 2 to occur.

FIG. 11 is a right side partial sectional view of the firearm 2 and the rapid reset fire control 1. FIG. 11 depicts the rapid reset fire control 1 installed within the lower receiver assembly 4 of the firearm 2. Portions of the right side of the upper receiver assembly 52, right side of the lower receiver assembly 53 and right side of the bolt carrier assembly 54 are not depicted so that conditions within the firearm 2 may be illustrated with greater clarity. FIG. 6 through FIG. 16 depict, in sequence, the conditions within the firearm 2 as the firearm 2 is operated by the user using the rapid reset fire control 1. This sequence includes the first firing of the firearm which is depicted in FIG. 7, the second firing of the firearm which is depicted in FIG. 16 as well as the cycling of the firearm 2 action by the operating system of the firearm 2 which is depicted in FIG. 7 through FIG. 13. The conditions which are depicted in FIG. 11 take place in sequence immediately after the conditions which are depicted in FIG. 10.

FIG. 11 depicts the conditions of the firearm 2 and the rapid reset fire control 1 after the first firing of the firearm 2. This first firing of the firearm 2, which is depicted in FIG. 7, has provided impetus to the operating system of the firearm 2 as known to the art. This impetus from the first firing of the firearm 2 has caused the bolt carrier assembly 5 to be displaced in the forward direction 31 within the firearm 2 from its previous position which is depicted in FIG. 10 to its current position which is depicted in FIG. 11.

This displacement of the bolt carrier assembly 5 in the forward direction 31 within the firearm 2 from its previous position which is depicted in FIG. 10 to its current position which is depicted in FIG. 11 has permitted the hammer body 36 to pivot about the axis of the hammer pin 13 in the clockwise direction 29 from its previous position which is depicted in FIG. 10 to its current position which is depicted in FIG. 11 by the urging of force from the hammer spring 17.

The path of travel of the hammer surface 59 illustrates the path taken by the hammer surface 28 as the hammer body 36 pivots about the axis of the hammer pin 13. As depicted in FIG. 11, the second surface 41 of the cam member 22 occupies a portion of the path of travel of the hammer surface 59. As depicted in FIG. 1, because the second surface 41 occupies the path of travel of the hammer surface 59, the aforementioned pivoting of the hammer body 36 in the clockwise direction 29 has caused the hammer surface 28 to begin engaging the second surface 41 of the cam member 22.

After the hammer surface 28 has begun engaging the second surface 41 of the cam member 22, force from the hammer spring 17 continues to urge the hammer body 36 to pivot further about the axis of the hammer pin 17 in the clockwise direction 29. Because the second surface 41 occupies a portion of the path of travel of the hammer surface 59, in order for the hammer body 36 to further pivot about the axis of the hammer pin 13 in the clockwise direction 29 from its current position which is depicted in FIG. 11 to its subsequent positions which are depicted in FIG. 13 and FIG. 15, the cam member 22 must be be displaced essentially in the rearward direction 32 in relation to its current position which is depicted in FIG. 11. This displacement of the cam member 22 essentially in the rearward direction 32 is accomplished by a camming engagement between the hammer surface 28 and the second surface 41 as the hammer surface 28 slides across the second surface 41 of the cam member 22.

As depicted in FIG. 11, the cam member 22 engages the cam member support 27. Because the cam member 22 engages the cam member support 27, the cam member 22 is prevented from being displaced essentially in the rearward direction 32 in relation to the cam member support 27.

As described in the figures, because the cam member 22 is prevented from being displaced essentially in the rearward direction 32 in relation to the cam member support 27, as the hammer surface 28 is displaced a certain length 64 across the second surface 41 of the cam member 22, force from the hammer spring 17 causes the trigger body 35 to pivot about the axis of the trigger pin 12 in the counter-clockwise direction 30 from its current position which is depicted in FIG. 11 to its subsequent position which is depicted in FIG. 13 through the aforementioned camming engagement between the hammer surface 28 and the second surface 41.

Due to the aforementioned manner in which the hammer surface 28, second surface 41, cam member 22 and cam member support 27 interact, as force from the hammer spring 17 causes the hammer body 36 to pivot about the axis of the hammer pin 13 in the clockwise direction 29 from its current position which is depicted in FIG. 11 to its subsequent position which is depicted in FIG. 13, force from the hammer spring 17 also causes the trigger body 36 to pivot about the axis of the trigger pin 12 in the counter-clockwise direction 30 from its current position which is depicted in FIG. 11 to its subsequent position which is depicted in FIG. 13.

If, after the first firing of the firearm 2, the user engages the trigger interface 20 with his or her finger 42 in such a manner that a significantly greater rearward force 47 is applied unto the trigger interface 20 than was needed to cause the first firing of the firearm 2 to occur, the conditions of the rapid reset fire control 1 within the firearm 2 will remain as depicted in FIG. 11 so long as such an engagement between the users finger 42 and the trigger interface 20 exists.

FIG. 11 depicts the user as continuing to engage the trigger interface 20 with his or her finger 42 in such a manner that essentially the same rearward force 47 is applied unto the trigger interface 20 as was needed to cause the first firing of the firearm 2 to occur.

FIG. 12 is an enlarged view depicting a portion of FIG. 11. FIG. 12 further illustrates the conditions of FIG. 11. Portions of the right side of the upper receiver assembly 52, right side of the lower receiver assembly 53 and right side of the bolt carrier assembly 54 are not depicted so that conditions within the firearm 2 may be illustrated with greater clarity. FIG. 6 through FIG. 16 depict, in sequence, the conditions within the firearm 2 as the firearm 2 is operated by the user using the rapid reset fire control 1. This sequence includes the first firing of the firearm which is depicted in FIG. 7, the second firing of the firearm which is depicted in FIG. 16 as well as the cycling of the firearm 2 action by the operating system of the firearm 2 which is depicted in FIG. 7 through FIG. 13. The conditions which are depicted in FIG. 12 take place in sequence immediately after the which are conditions depicted in FIG. 10.

FIG. 12 depicts the conditions of the firearm 2 and the rapid reset fire control 1 after the first firing of the firearm 2. This first firing of the firearm 2, which is depicted in FIG. 7, has provided impetus to the operating system of the firearm 2 as known to the art. This impetus from the first firing of the firearm 2 has caused the bolt carrier assembly 5 to be displaced in the forward direction 31 within the firearm 2 from its previous position which is depicted in FIG. 10 to its current position which is depicted in FIG. 12.

This displacement of the bolt carrier assembly 5 in the forward direction 31 within the firearm 2 from its previous position which is depicted in FIG. 10 to its current position which is depicted in FIG. 12 has permitted the hammer body 36 to pivot about the axis of the hammer pin 13 in the clockwise direction 29 from its previous position which is depicted in FIG. 10 to its current position which is depicted in FIG. 12 by the urging of force from the hammer spring 17.

The path of travel of the hammer surface 59 illustrates the path taken by the hammer surface 28 as the hammer body 36 pivots about the axis of the hammer pin 13. As depicted in FIG. 12, the second surface 41 of the cam member 22 occupies a portion of the path of travel of the hammer surface 59. As depicted in FIG. 12, because the second surface 41 occupies the path of travel of the hammer surface 59, the aforementioned pivoting of the hammer body 36 in the clockwise direction 29 has caused the hammer surface 28 to begin engaging the second surface 41 of the cam member 22.

After the hammer surface 28 has begun engaging the second surface 41 of the cam member 22, force from the hammer spring 17 continues to urge the hammer body 36 to pivot further about the axis of the hammer pin 17 in the clockwise direction 29. Because the second surface 41 occupies a portion of the path of travel of the hammer surface 59, in order for the hammer body 36 to further pivot about the axis of the hammer pin 13 in the clockwise direction 29 from its current position which is depicted in FIG. 12 to its subsequent positions which are depicted in FIG. 13 and FIG. 15, the cam member 22 must be displaced essentially in the rearward direction 32 in relation to its current position which is depicted in FIG. 12. This displacement of the cam member 22 essentially in the rearward direction 32 is accomplished by a camming engagement between the hammer surface 28 and the second surface 41 as the hammer surface 28 slides across the second surface 41 of the cam member 22.

As depicted in FIG. 12, the cam member 22 engages the cam member support 27. Because the cam member 22 engages the cam member support 27, the cam member 22 is prevented from being displaced essentially in the rearward direction 32 in relation to the cam member support 27.

As described in the figures, because the cam member 22 is prevented from being displaced essentially in the rearward direction 32 in relation to the cam member support 27, as the hammer surface 28 is displaced a certain length 64 across the second surface 41 of the cam member 22, force from the hammer spring 17 causes the trigger body 35 to pivot about the axis of the trigger pin 12 in the counter-clockwise direction 30 from its current position which is depicted in FIG. 12 to its subsequent position which is depicted in FIG. 13 through the aforementioned camming engagement between the hammer surface 28 and the second surface 41.

Due to the aforementioned manner in which the hammer surface 28, second surface 41, cam member 22 and cam member support 27 interact, as force from the hammer spring 17 causes the hammer body 36 to pivot about the axis of the hammer pin 13 in the clockwise direction 29 from its current position which is depicted in FIG. 12 to its subsequent position which is depicted in FIG. 13, force from the hammer spring 17 also causes the trigger body 36 to pivot about the axis of the trigger pin 12 in the counter-clockwise direction 30 from its current position which is depicted in FIG. 12 to its subsequent position which is depicted in FIG. 13.

If, after the first firing of the firearm 2, the user engages the trigger interface 20 with his or her finger 42 in such a manner that a significantly greater rearward force 47 is applied unto the trigger interface 20 than was needed to cause the first firing of the firearm 2 to occur, the conditions of the rapid reset fire control 1 within the firearm 2 will remain as depicted in FIG. 12 so long as such an engagement between the users finger 42 and the trigger interface 20 exists.

FIG. 12 depicts the user as continuing to engage the trigger interface 20 with his or her finger 42 in such a manner that essentially the same rearward force 47 is applied unto the trigger interface 20 as was needed to cause the first firing of the firearm 2 to occur.

FIG. 12 depicts the angle of the second surface 58. This angle of the second surface is configured in conjunction with geometry of the other elements of the rapid reset fire control 1 such that the functions of the present invention as described in FIG. 6 through FIG. 16 may be performed.

FIG. 13 is a right side partial sectional view of the firearm 2 and the rapid reset fire control 1. FIG. 13 depicts the rapid reset fire control 1 installed within the lower receiver assembly 4 of the firearm 2. Portions of the right side of the upper receiver assembly 52, right side of the lower receiver assembly 53 and right side of the bolt carrier assembly 54 are not depicted so that conditions within the firearm 2 may be illustrated with greater clarity. FIG. 6 through FIG. 16 depict, in sequence, the conditions within the firearm 2 as the firearm 2 is operated by the user using the rapid reset fire control 1. This sequence includes the first firing of the firearm which is depicted in FIG. 7, the second firing of the firearm which is depicted in FIG. 16 as well as the cycling of the firearm 2 action by the operating system of the firearm 2 which is depicted in FIG. 7 through FIG. 13. The conditions which are depicted in FIG. 13 take place in sequence immediately after the conditions which are depicted in FIG. 11.

FIG. 13 depicts the conditions of the firearm 2 and the rapid reset fire control 1 after the first firing of the firearm 2. This first firing of the firearm 2, which is depicted in FIG. 7, has provided impetus to the operating system of the firearm 2 as known to the art. This impetus from the first firing of the firearm 2 has caused the bolt carrier assembly 5 to be displaced in the forward direction 31 within the firearm 2 from its previous position which is depicted in FIG. 11 to its current position which is depicted in FIG. 13.

This displacement of the bolt carrier assembly 5 in the forward direction 31 within the firearm 2 from its previous position which is depicted in FIG. 11 to its current position which is depicted in FIG. 13 has caused the bolt carrier assembly 5 to achieve its in-battery condition and has also caused a live ammunition cartridge 44 to be loaded into the firing chamber 45.

It is worthy to note that FIG. 13 depicts the bolt carrier assembly 5 as having achieved its in-battery condition while the rapid reset fire control 1 has not yet achieved its reset condition. Because the bolt carrier assembly 5 has achieved its in-battery condition before the rapid reset fire control 1 has achieved its reset condition, the firearm 2 will immediately achieve the ready to fire condition the instant the rapid reset fire control achieves its reset condition as subsequently depicted in FIG. 15. Therefore, for the sake of reliable function of the present invention, the rapid reset fire control 1 may be designed in a manner such that the bolt carrier assembly 5 is likely to achieve its in-battery condition before the rapid reset fire control 1 has achieved its reset condition.

As described in the figures, force from the hammer spring 17 continually urges the hammer body 36 to pivot further about the axis of the hammer pin 17 in the clockwise direction 29. FIG. 13 depicts the conditions of the firearm 2 and the rapid reset fire control 1 after force from the hammer spring 17 has caused the hammer body 36 to pivot about the axis of the hammer pin 13 in the clockwise direction 29 from its previous position which is depicted in FIG. 1 to its current position which is depicted in FIG. 13.

Due to the aforementioned manner in which the hammer surface 28, second surface 41, cam member 22 and cam member support 27 interact as previously described in both FIG. 11 and FIG. 12, as force from the hammer spring 17 has caused the hammer body 36 to pivot about the axis of the hammer pin 13 in the clockwise direction 29 from its previous position which is depicted in FIG. 11 to its current position which is depicted in FIG. 13, force from the hammer spring 17 has also caused the trigger body 36 to pivot about the axis of the trigger pin 12 in the counter-clockwise direction 30 from its previous position which is depicted in FIG. 11 to its current position which is depicted in FIG. 13.

Because the trigger interface 20 is an associated feature of the trigger body 35 and therefore moves with the trigger body 35, the aforementioned pivotal displacement of the trigger body 35 about the axis of the trigger pin 12 in the counter-clockwise direction 30 has caused the trigger interface 20 to be displaced essentially in the forward direction 31 from its previous position which is depicted in FIG. 11 to its current position which is depicted in FIG. 13.

The path of travel of the hammer sear 63 illustrates the path taken by the hammer sear 19 as the hammer body 36 pivots about the axis of the hammer pin 13. Because the trigger sear 18 is an associated feature of the trigger body 35 and therefore moves with the trigger body 35, the aforementioned pivotal displacement of the trigger body 35 about the axis of the trigger pin 12 in the counter-clockwise direction 30 from its previous position which is depicted in FIG. 11 to its current position which is depicted in FIG. 13 has caused the trigger sear 18 to pivot about the axis of the trigger pin 12 in the counter-clockwise direction 30 from its previous position which is depicted in FIG. 11 to its current position which is depicted in FIG. 13. This current position of the trigger sear 18, which is depicted in FIG. 13, is such that the trigger sear 18 occupies a portion of the path of travel of the hammer sear 63.

FIG. 13 depicts a cuspal engagement between the hammer surface 28 and the second surface 41 of the cam member 22. This cuspal engagement between the hammer surface 28 and the second surface 41 of the cam member 22 is such that further pivotal displacement of the hammer body 36 about the axis of the hammer pin 13 in the clockwise direction 29 in relation to its current position which is depicted in FIG. 13 will cause the hammer surface 28 to disengage from the second surface 41 of the cam member 22. As described in the figures, force from the hammer spring 17 continually urges the hammer body 36 to pivot further about the axis of the hammer pin 17 in the clockwise direction 29. Therefore, as described in the figures, once the hammer surface 28 is disengaged from the second surface 41 of the cam member 22, the hammer body 36 will be caused to pivot about the axis of the hammer pin 13 in the clockwise direction 29 from its current position which is depicted in FIG. 13 to its subsequent position which is depicted in FIG. 15 by the urging of force from the hammer spring 17.

Because the trigger sear 18 occupies the path of travel of the hammer sear 63, the aforementioned pivotal displacement of the hammer body 36 about the axis of the hammer pin 13 in the clockwise direction 31 from its current position which is depicted in FIG. 13 to its subsequent position which is depicted in FIG. 15 will cause the hammer sear 19 to begin engaging trigger sear 18. As subsequently depicted in FIG. 15, this engagement between the hammer sear 19 and the trigger sear 18 prevents further pivotal displacement of the hammer body 36 in the clockwise direction 29 and returns the rapid reset fire control 1 to its reset condition.

FIG. 13 depicts the user as continuing to engage the trigger interface 20 with his or her finger 42 in such a manner that essentially the same rearward force 47 is applied unto the trigger interface 20 as was needed to cause the first firing of the firearm 2 to occur.

Figure 14:
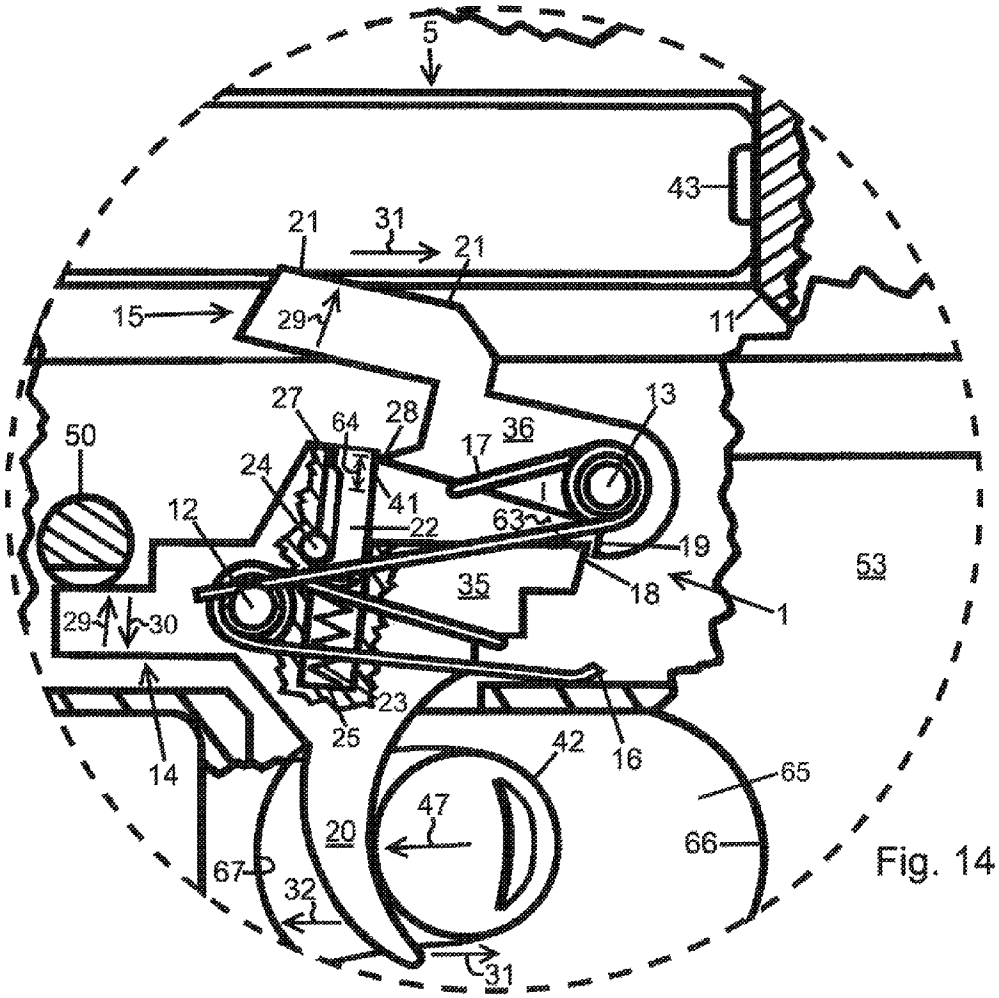
FIG. 14 is an enlarged view depicting a portion of FIG. 13.

FIG. 14 is an enlarged view depicting a portion of FIG. 13. FIG. 14 further illustrates the conditions of FIG. 13. Portions of the right side of the upper receiver assembly 52, right side of the lower receiver assembly 53 and right side of the bolt carrier assembly 54 are not depicted so that conditions within the firearm 2 may be illustrated with greater clarity. FIG. 6 through FIG. 16 depict, in sequence, the conditions within the firearm 2 as the firearm 2 is operated by the user using the rapid reset fire control 1. This sequence includes the first firing of the firearm which is depicted in FIG. 7, the second firing of the firearm which is depicted in FIG. 16 as well as the cycling of the firearm 2 action by the operating system of the firearm 2 which is depicted in FIG. 7 through FIG. 13. The conditions which are depicted in FIG. 14 take place in sequence immediately after the conditions which are depicted in FIG. 11.

FIG. 14 depicts the conditions of the firearm 2 and the rapid reset fire control 1 after the first firing of the firearm 2. This first firing of the firearm 2, which is depicted in FIG. 7, has provided impetus to the operating system of the firearm 2 as known to the art. This impetus from the first firing of the firearm 2 has caused the bolt carrier assembly 5 to be displaced in the forward direction 31 within the firearm 2 from its previous position which is depicted in FIG. 11 to its current position which is depicted in FIG. 14.

This displacement of the bolt carrier assembly 5 in the forward direction 31 within the firearm 2 from its previous position which is depicted in FIG. 11 to its current position which is depicted in FIG. 14 has caused the bolt carrier assembly 5 to achieve its in-battery condition and has also caused a live ammunition cartridge 44 to be loaded into the firing chamber 45.

It is worthy to note that FIG. 14 depicts the bolt carrier assembly 5 as having achieved its in-battery condition while the rapid reset fire control 1 has not yet achieved its reset condition. Because the bolt carrier assembly 5 has achieved its in-battery condition before the rapid reset fire control 1 has achieved its reset condition, the firearm 2 will immediately achieve the ready to fire condition the instant the rapid reset fire control achieves its reset condition as subsequently depicted in FIG. 15. Therefore, for the sake of reliable function of the present invention, the rapid reset fire control 1 may be designed in a manner such that the bolt carrier assembly 5 is likely to achieve its in-battery condition before the rapid reset fire control 1 has achieved its reset condition.

As described in the figures, force from the hammer spring 17 continually urges the hammer body 36 to pivot further about the axis of the hammer pin 17 in the clockwise direction 29. FIG. 14 depicts the conditions of the firearm 2 and the rapid reset fire control 1 after force from the hammer spring 17 has caused the hammer body 36 to pivot about the axis of the hammer pin 13 in the clockwise direction 29 from its previous position which is depicted in FIG. 11 to its current position which is depicted in FIG. 14.

Due to the aforementioned manner in which the hammer surface 28, second surface 41, cam member 22 and cam member support 27 interact as previously described in both FIG. 11 and FIG. 12, as force from the hammer spring 17 has caused the hammer body 36 to pivot about the axis of the hammer pin 13 in the clockwise direction 29 from its previous position which is depicted in FIG. 11 to its current position which is depicted in FIG. 14, force from the hammer spring 17 has also caused the trigger body 36 to pivot about the axis of the trigger pin 12 in the counter-clockwise direction 30 from its previous position which is depicted in FIG. 11 to its current position which is depicted in FIG. 14.

Because the trigger interface 20 is an associated feature of the trigger body 35 and therefore moves with the trigger body 35, the aforementioned pivotal displacement of the trigger body 35 about the axis of the trigger pin 12 in the counter-clockwise direction 30 has caused the trigger interface 20 to be displaced essentially in the forward direction 31 from its previous position which is depicted in FIG. 11 to its current position which is depicted in FIG. 14.

The path of travel of the hammer sear 63 illustrates the path taken by the hammer sear 19 as the hammer body 36 pivots about the axis of the hammer pin 13. Because the trigger sear 18 is an associated feature of the trigger body 35 and therefore moves with the trigger body 35, the aforementioned pivotal displacement of the trigger body 35 about the axis of the trigger pin 12 in the counter-clockwise direction 30 from its previous position which is depicted in FIG. 11 to its current position which is depicted in FIG. 14 has caused the trigger sear 18 to pivot about the axis of the trigger pin 12 in the counter-clockwise direction 30 from its previous position which is depicted in FIG. 11 to its current position which is depicted in FIG. 14. This current position of the trigger sear 18, which is depicted in FIG. 14, is such that the trigger sear 18 occupies a portion of the path of travel of the hammer sear 63.

FIG. 14 depicts a cuspal engagement between the hammer surface 28 and the second surface 41 of the cam member 22. This cuspal engagement between the hammer surface 28 and the second surface 41 of the cam member 22 is such that further pivotal displacement of the hammer body 36 about the axis of the hammer pin 13 in the clockwise direction 29 in relation to its current position which is depicted in FIG. 14 will cause the hammer surface 28 to disengage from the second surface 41 of the cam member 22. As described in the figures, force from the hammer spring 17 continually urges the hammer body 36 to pivot further about the axis of the hammer pin 17 in the clockwise direction 29. Therefore, as described in the figures, once the hammer surface 28 is disengaged from the second surface 41 of the cam member 22, the hammer body 36 will be caused to pivot about the axis of the hammer pin 13 in the clockwise direction 29 from its current position which is depicted in FIG. 14 to its subsequent position which is depicted in FIG. 15 by the urging of force from the hammer spring 17.

Because the trigger sear 18 occupies the path of travel of the hammer sear 63, the aforementioned pivotal displacement of the hammer body 36 about the axis of the hammer pin 13 in the clockwise direction 31 from its current position which is depicted in FIG. 14 to its subsequent position which is depicted in FIG. 15 will cause the hammer sear 19 to begin engaging trigger sear 18. As subsequently depicted in FIG. 15, this engagement between the hammer sear 19 and the trigger sear 18 prevents further pivotal displacement of the hammer body 36 in the clockwise direction 29 and returns the rapid reset fire control 1 to its reset condition.

FIG. 14 depicts the user as continuing to engage the trigger interface 20 with his or her finger 42 in such a manner that essentially the same rearward force 47 is applied unto the trigger interface 20 as was needed to cause the first firing of the firearm 2 to occur.

FIG. 15 is a right side partial sectional view of the firearm 2 and the rapid reset fire control 1. FIG. 15 depicts the rapid reset fire control 1 installed within the lower receiver assembly 4 of the firearm 2. Portions of the right side of the upper receiver assembly 52, right side of the lower receiver assembly 53 and right side of the bolt carrier assembly 54 are not depicted so that conditions within the firearm 2 may be illustrated with greater clarity. FIG. 6 through FIG. 16 depict, in sequence, the conditions within the firearm 2 as the firearm 2 is operated by the user using the rapid reset fire control 1. This sequence includes the first firing of the firearm which is depicted in FIG. 7, the second firing of the firearm which is depicted in FIG. 16 as well as the cycling of the firearm 2 action by the operating system of the firearm 2 which is depicted in FIG. 7 through FIG. 13. The conditions which are depicted in FIG. 15 take place in sequence immediately after the conditions which are depicted in FIG. 13.

FIG. 15 depicts the conditions of the firearm 2 and the rapid reset fire control 1 after the first firing of the firearm 2. This first firing of the firearm 2, which is depicted in FIG. 7, has provided impetus to the operating system of the firearm 2 as known to the art.

As described in the figures, this impetus from the first firing of the firearm 2 has caused the bolt carrier assembly 5 to be displaced within the firearm 2. As depicted in FIG. 15, this displacement has caused the bolt carrier assembly 5 to achieve its in-battery condition and has also caused a live ammunition cartridge 44 to be loaded into the firing chamber 45. Therefore, as known to the art, the firearm 2 and the rapid reset fire control 2 of FIG. 15 have completed a full cycle of operation for a typical self-loading firearm.

As depicted in FIG. 15, the in-battery condition of the bolt carrier assembly 5 is such that the bolt carrier assembly 5 is proximate to the firing chamber 45. As known to the art, when the firearm 2 achieves the conditions which are depicted in FIG. 15, the live ammunition cartridge 44 which is present in the firing chamber 45 may be fired by the firearm 2 in a manner such that proper function of the firearm 2 is achieved.

As described in the figures, force from the hammer spring 17 continually urges the hammer body 36 to pivot further about the axis of the hammer pin 17 in the clockwise direction 29.

This force from the hammer spring 17 has caused the hammer body 36 to pivot about the axis of the hammer pin 13 in the clockwise direction 29 from its previous position as depicted in FIG. 13 to its current position as depicted in FIG. 15. Because the hammer surface 21 is an associated feature of the hammer body 36 and moves with the hammer body 36, this pivotal displacement of the hammer body 36 from its previous position as depicted in FIG. 13 to its current position as depicted in FIG. 15 has caused the hammer surface 28 to slide across the second surface 41 of the cam member 22 through a camming engagement. This camming engagement causes the hammer surface 28 to slip off the cusp of the second surface 41 such that the hammer surface 28 disengages from the second surface 41 of the cam member 22.

At the instant the hammer surface 28 disengaged from the second surface 28 of the cam member 22, the trigger body 35 is oriented in a manner such that the trigger sear 18 occupies a portion of the path of travel of the hammer sear 63. Once the hammer surface 28 disengages from the second surface 41 by the aforementioned camming engagement, the hammer surface is caused to pivot about the axis of the hammer pin 18 in the clockwise direction 29 from its previous position which is depicted in FIG. 13 to its current position which is depicted in FIG. 15 by the urging of force from the hammer spring 17. Because the trigger sear 18 occupied the path of travel of the hammer sear 63, the aforementioned pivotal displacement of the hammer body 36 about the axis of the hammer pin 13 in the clockwise direction 29 from its previous position which is depicted in FIG. 13 to its current position which is depicted in FIG. 15 has caused the hammer sear 19 to engage the trigger sear 18.

FIG. 15 depicts the rapid reset fire control 1 as having reattained its reset condition due to the functions of the present invention. As depicted in FIG. 15, this reset condition of the rapid reset fire control 1 is such that the trigger sear 18 engages the hammer sear 19. As known to the art, this engagement between the trigger sear 18 and the hammer sear 19 prevents the hammer body 36 from pivoting about the axis of the hammer pin 13 in the clockwise direction 29. Because engagement between the trigger sear 18 and the hammer sear 19 prevents the hammer body 36 from pivoting about the axis of the hammer pin 13 in the clockwise direction 29, the firearm 2 is prevented from firing the live ammunition cartridge 44 which is present in the firing chamber 45 while the rapid reset fire control 1 is in its reset condition.

As depicted in FIG. 15, when the rapid reset fire control 1 achieves its reset condition, the trigger interface 20 assumes its reset position. As depicted in FIG. 15, this reset position of the trigger interface 20 is such that the trigger interface 20 is positioned distant from the rearward portion of the trigger well 67 in comparison to the firing position of the trigger interface 20 which is depicted in FIG. 16.

The sequence of events by which the present invention harnesses force from the hammer spring 17 to cause the rapid reset fire control 1 to reattain its reset condition, as described in FIG. 6 through FIG. 15, have occurred despite the user having continued to engage the trigger interface 20 with his or her finger 42 in such a manner that essentially the same rearward force 47 has been applied unto the trigger interface 20 as was needed to cause the first firing of the firearm 2 to occur. Said force from the hammer spring 17 has overcome the force applied to the trigger interface 20 by the finger 42 of the user, such that the rapid reset fire control 1 has reattained its reset condition. However, the instant that the hammer surface 28 and the second surface 41 of the cam member 22 disengage, this force from the hammer spring 17 ceases to urge the trigger interface 20 in the forward direction 31.

Because the force from the hammer spring 17 ceases to urge the trigger interface 20 in the forward direction 31 instantaneously when the hammer surface 28 disengages from the second surface 41 of the cam member 22, if the user has continued to engage the trigger interface 20 with his or her finger 42 in such a manner that essentially the same rearward force 47 is applied unto the trigger interface 20 as was needed to cause the first firing of the firearm 2 to occur, the trigger interface 20 will immediately be urged essentially in the rearward direction 32 due to a nearly instantaneous change in the balance of the forces fighting for control over the direction that the trigger interface 20 is to be displaced.

As depicted in FIG. 15, the user has continued to engage the trigger interface 20 with his or her finger 42 in such a manner that essentially the same rearward force 47 is applied unto the trigger interface 20 as was needed to cause the first firing of the firearm 2 to occur. As subsequently described in FIG. 16, this rearward force 47 which is applied unto the trigger interface 20 causes the trigger interface 20 to be displaced essentially in the rearward direction 32 from its current position which is depicted in FIG. 15 to its subsequent position which is depicted in FIG. 16. As described in the figures, this displacement of the trigger interface 20 essentially in the rearward direction 32 causes the trigger sear 18 to be disengaged from the hammer sear 19 in a manner such that the firearm 2 will fire the live ammunition cartridge 44 which is present in the firing chamber 45 as known to the art.

If the user does not wish to cause the firearm 2 to fire an additional live ammunition cartridge 44 after the first firing of the firearm 2, the user need only reduce the rearward force 47 being applied with his or her finger 42 to the trigger interface 20 such that said rearward force 47 is less than the rearward force 47 which was required for the first firing of the firearm 2 to occur.

FIG. 16 is a right side partial sectional view of the firearm 2 and the rapid reset fire control 1. FIG. 16 depicts the rapid reset fire control 1 installed within the lower receiver assembly 4 of the firearm 2. Portions of the right side of the upper receiver assembly 52, right side of the lower receiver assembly 53 and right side of the bolt carrier assembly 54 are not depicted so that conditions within the firearm 2 may be illustrated with greater clarity. FIG. 6 through FIG. 16 depict, in sequence, the conditions within the firearm 2 as the firearm 2 is operated by the user using the rapid reset fire control 1. This sequence includes the first firing of the firearm which is depicted in FIG. 7, the second firing of the firearm which is depicted in FIG. 16 as well as the cycling of the firearm 2 action by the operating system of the firearm 2 which is depicted in FIG. 7 through FIG. 13. The conditions which are depicted in FIG. 16 take place in sequence immediately after the conditions which are depicted in FIG. 15.

FIG. 16 depicts the conditions of the firearm 2 and the rapid reset fire control 1 during the second firing of the firearm 2. In order for the user to cause the firearm 2 of FIG. 15 to fire the live ammunition cartridge 44 which is present in the firing chamber 45, the user has engaged the trigger interface 20 with his or her finger 42 in a manner such that a rearward force 47 is applied unto the trigger interface 20.

As depicted in FIG. 16, this rearward force 47 which is applied unto the trigger interface 20 has caused the trigger interface 20 to be displaced essentially in the rearward direction 32 from its previous position which is depicted in FIG. 15 to its current position which is depicted in FIG. 16.

Because the trigger interface 20 is an associated feature of the trigger body 35 and therefore moves with the trigger body 35, the aforementioned displacement of the trigger interface 20 essentially in the rearward direction 32 from its previous position which is depicted in FIG. 15 to its current position which is depicted in FIG. 16 has caused the trigger body 35 to pivot about the axis of the trigger pin 12 in the clockwise direction 29 from its previous position which is depicted in FIG. 15 to its current position which is depicted in FIG. 16.

Because the trigger sear 18 is an associated feature of the trigger body 35 and therefore moves with the trigger body 35, the aforementioned pivotal displacement of the trigger body 35 about the axis of the trigger pin 12 in the clockwise direction 29 from its previous position which is depicted in FIG. 15 to its current position which is depicted in FIG. 16 has caused the trigger sear 18 to be pivotally displaced about the axis of the trigger pin 12 in a manner such that the trigger sear 18 disengages from the hammer sear 19.

As described in the figures, this disengagement of the trigger sear 18 from the hammer sear 19 has permitted force from the hammer spring 17 to cause the hammer body 36 to pivot about the axis of the hammer pin 13 in the clockwise direction 29 from its previous position which is depicted in FIG. 15 to its current position which is depicted in FIG. 16.

As described in the figures, this displacement of the hammer body 36 from its previous position which is depicted in FIG. 15 to its current position which is depicted in FIG. 16 has caused the striking surface 21 to engage the firing pin 43. As known to the art, this engagement between the striking surface 21 and the firing pin 43 has caused the firing pin 43 to engage the live ammunition cartridge 44 which is present in the firing chamber 45.

As known to the art, the firing pin 43 has engaged the live ammunition cartridge 44 which is present in the firing chamber 45 in a manner such that the live ammunition cartridge 44 is fired by the firearm 2. This second firing of the firearm 2, which is depicted in FIG. 16, provides impetus to the operating system of the firearm 2 as known to the art. As known to the art, this impetus from the second firing of the firearm 2 causes the bolt carrier assembly 5 to be displaced within the firearm 2 in both the rearward direction 32, in a manner such as depicted in FIG. 8 through FIG. 10, and then in the forward direction 31, in a manner such as depicted in FIG. 11 through FIG. 13.

FIG. 16 depicts the trigger interface 20 in its firing position. As depicted in FIG. 16, this firing position of the trigger interface 20 is such that the trigger interface 20 is positioned proximate to the rearward portion of the trigger well 67 in comparison to the reset position of the trigger interface 20 which is depicted in FIG. 15. As depicted in FIG. 16, during the firing of the firearm 2 the trigger interface 20 assumes its firing position.

From the first firing of the firearm 2 which is depicted in FIG. 7 to the second firing of the firearm 2 which is depicted in FIG. 16, the user has continued engaging the trigger interface 20 with his or her finger 42 in a manner such that essentially the same rearward force 47 is applied unto the trigger interface 20 as is required to cause the firearm 2 to fire. Therefore an analysis of the figures makes it readily understood that the rapid reset fire control 1 allows for consecutive firings of the firearm 2 to occur rapidly wherein the trigger is placed in its reset position, not by the urging of the user, but by interaction between the rapid reset fire control 1 and the firearm 2. Therefore it is readily understood that if, after the conditions depicted in FIG. 16, the user continues to engage the trigger interface 20 with his or her finger 42 in such a manner that essentially the same rearward force 47 is applied unto the trigger interface 20 as was required to cause the firing of the firearm 2, the firearm 2 will continue to fire rapidly until live ammunition cartridges 44 are no longer available for the action of the firearm 2 to load into the firing chamber 45.

Figure 17:
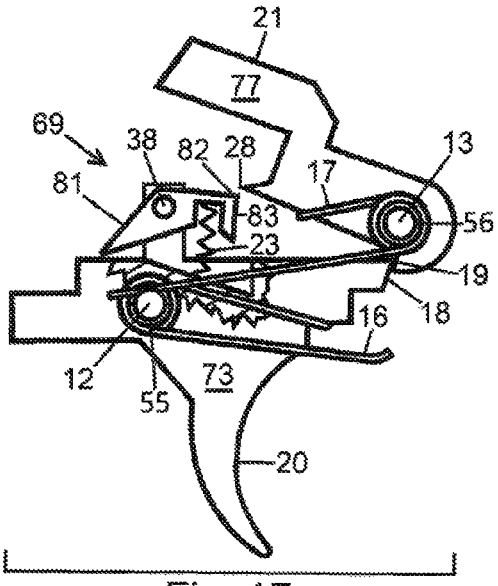
FIG. 17 is a right side partial sectional view of a second embodiment of the present invention 69.

FIG. 17 is a right side partial sectional view of a second embodiment of the present invention 69. The second embodiment of the present invention 69 may be installed within the firearm 2 of FIG. 4 and engage with the firearm 2 of FIG. 4 in a manner such that the functions of the present invention as described in FIG. 6 through FIG. 16 may be performed. Instead of utilizing the plunger-like design of the cam member 22 of FIG. 1, the second embodiment of the moving part 81 utilizes a pivotal body to perform all the functions of the cam member 22 of FIG. 1. FIG. 17 depicts the second embodiment of the present invention 69 in its reset condition. As known to the art, this reset condition is such that the trigger sear 18 engages the hammer sear 19.

The second embodiment of the present invention comprises a number of features which are similar or identical to features found on the rapid reset fire control 1 of FIG. 3, these features perform identical function as the corresponding features found on the rapid reset fire control 1 of FIG. 3. The second embodiment of the present invention 69 of FIG. 17 comprises a second embodiment of the trigger body 73, a second embodiment of the hammer body 77, a second embodiment of the cam member 81, a pivot pin 38, a second embodiment of the first surface 82, a second embodiment of the second surface 83, a user interface 20, a cam member spring 23, a trigger spring 16, a trigger sear 18, a trigger pin hole 55 and a trigger pin 12, a striking surface 21, a hammer surface 28, a hammer pin 13, a hammer pin hole 56, a hammer sear 19 and a hammer spring 17.

Additional embodiments of the present invention are possible which essentially conform to alternative fire control group configurations as known to the art which differ in arrangement, geometry, dimensions and operation.

Figure 18:
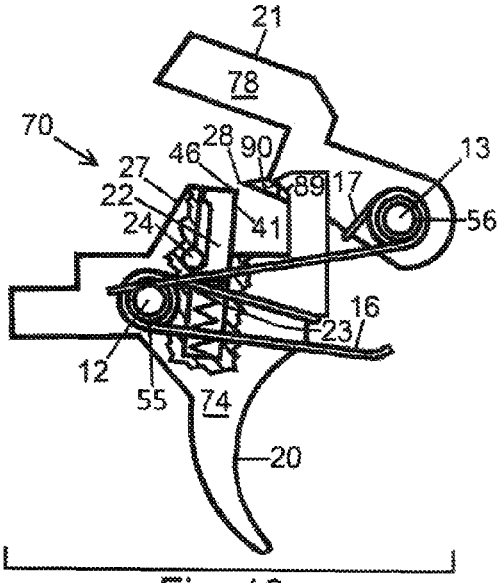
FIG. 18 is a right side partial sectional view of a third embodiment of the present invention 70.

FIG. 18 is a right side partial sectional view of a third embodiment of the present invention 70. The third embodiment of the present invention 70 may be installed within the firearm 2 of FIG. 4 and engage with the firearm 2 of FIG. 4 in a manner such that the functions of the present invention as described in FIG. 6 through FIG. 16 may be performed. Instead of utilizing the typical AR-15 style trigger sear and hammer sear arrangement like that of the trigger sear 18 and hammer sear 19 of FIG. 3, the sears are located in an alternative location upon the trigger body and the hammer body. Alternative sear arrangements, like that depicted in FIG. 18 may have particular usefulness in embodiments of the present invention designed for precision or match shooting. Alternate sear arrangements, like that depicted in FIG. 18 may also have particular suitability for embodiments of the present invention designed for various types of firearms. The second embodiment of the trigger sear 89 and second embodiment of the hammer sear 90 perform all the functions of the trigger sear 18 and hammer sear 19 of FIG. 3. FIG. 18 depicts the third embodiment of the present invention 69 in its reset condition. As known to the art, this reset condition is such that the second embodiment of the trigger sear 89 engages the second embodiment of the hammer sear 90.

The third embodiment of the present invention comprises a number of features which are similar or identical to features found on the rapid reset fire control 1 of FIG. 3, these features perform identical function as the corresponding features found on the rapid reset fire control 1 of FIG. 3. The third embodiment of the present invention 70 of FIG. 18 comprises a third embodiment of the trigger body 74, a third embodiment of the hammer body 78, a cam member 22, the first surface 46, the second surface 41, a user interface 20, a cam member spring 23, a trigger spring 16, a trigger pin hole 55 and a trigger pin 12, a striking surface 21, a hammer surface 28, a hammer pin 13, a hammer pin hole 56, a hammer sear 19, the second embodiment of the trigger sear 89, a cam member support 27, a cam member pin 24, a second embodiment of the hammer sear 9 and a hammer spring 17.

Additional embodiments of the present invention are possible which essentially conform to alternative fire control group configurations as known to the art which differ in arrangement, geometry, dimensions and operation.

Figure 19:
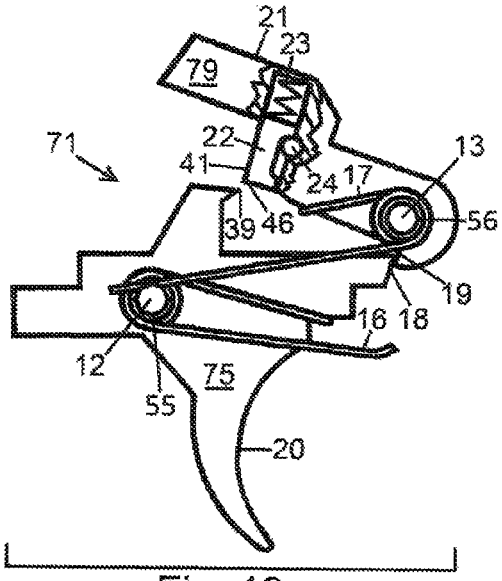
FIG. 19 is a right side partial sectional view of a fourth embodiment of the present invention 71.

FIG. 19 is a right side partial sectional view of a fourth embodiment of the present invention 71. The fourth embodiment of the present invention 71 may be installed within the firearm 2 of FIG. 4 and engage with the firearm 2 of FIG. 4 in a manner such that the functions of the present invention as described in FIG. 6 through FIG. 16 may be performed. Instead of placing the cam member 22 upon the trigger body 35 as is the arrangement of FIG. 3, the fourth embodiment of the present invention 71 places the cam member 22 upon the fourth embodiment of the hammer body 79 as depicted in FIG. 19. Alternate arrangements of certain features of the present invention, like that depicted in FIG. 18, may have particular suitability for embodiments of the present invention designed for various types of firearms. The cam member 22 depicted in FIG. 19 interacts with the trigger surface 39 in order to perform all the functions of the cam member 22 of FIG. 3.

FIG. 19 depicts the fourth embodiment of the present invention 69 in its reset condition. As known to the art, this reset condition is such that the trigger sear 18 engages the hammer sear 19.

The fourth embodiment of the present invention 71 comprises a number of features which are similar or identical to features found on the rapid reset fire control 1 of FIG. 3, these features perform identical function as the corresponding features found on the rapid reset fire control 1 of FIG. 3. The fourth embodiment of the present invention 71 of FIG. 19 comprises a forth embodiment of the trigger body 75, a forth embodiment of the hammer body 79, a cam member 22, the first surface 46, the second surface 41, a user interface 20, a cam member spring 23, a trigger spring 16, a trigger pin hole 55 and a trigger pin 12, a striking surface 21, a hammer surface 28, a hammer pin 13, a hammer pin hole 56, a hammer sear 19, the second embodiment of the trigger sear 89, a cam member support 27, a cam member pin 24, a second embodiment of the hammer sear 9 and a hammer spring 17.

Additional embodiments of the present invention are possible which essentially conform to alternative fire control group configurations as known to the art which differ in arrangement, geometry, dimensions and operation.

DETAILED DESCRIPTION OF SELECT EXEMPLARY EMBODIMENTS

The present invention may be embodied in other specific forms without departing from its structures, methods, or other essential characteristics as broadly described herein and claimed hereinafter. The described embodiments are to be considered in all respects only as illustrative, and not restrictive. The scope of the present invention is, therefore, indicated by the appended claims, rather than by the foregoing description. All changes that come within the meaning and range of equivalency of the claims are to be embraced within their scope. The present invention may be embodied in other specific forms without departing from its spirit or essential characteristics. All of the parts discussed herein may be made of metal, plastic or composites. In addition, the parts may be machined, cast, molded, extruded, stamped or forged. The described embodiments are to be considered in all respects only as illustrative and not restrictive. All changes and alternatives that would be known to one of skill in the art are embraced within the scope of the present invention.

One exemplary embodiment of the present invention is well illustrated by the rapid reset fire control 1 of FIG. 3. The rapid reset fire control 1 of FIG. 3 may be used with the firearm 2 of FIG. 4 in order that the functions of the present invention may be performed. The rapid reset fire control 1 of FIG. 3 may be manufactured using similar materials, techniques, arrangements, geometries and dimensions as used to manufacture similar fire control groups for firearms which are known to the art.

The rapid reset fire control 1 of FIG. 3 is well suited for being constructed primarily of steel, as steel construction provides high durability and ease of manufacture. The rapid reset fire control 1 of FIG. 3 is well suited for being manufactured using metal casting and metal machining techniques which are known to the art. In particular, the trigger body 35 and hammer body 36 are well suited for being manufactured from steel castings. In order to manufacture the trigger body 35 and hammer body 36 using steel castings, their basic shapes are first cast of steel. After this, the steel castings of the trigger body 35 and hammer body 36 are machined to include the particular arrangements, geometries and dimensions of the features found on the trigger body 35 and hammer body 36 as illustrated in FIG. 3 as required to perform the functions of the rapid reset fire control 1 As described in the figures.

The particular methods of machining these steel castings of the trigger body 35 and hammer body 36 are known to the art. These machining processes may include milling, turning, drilling and grinding. The particular features which are machined into the steel casting of the hammer body 36 are the striking surface 21, the hammer surface 28, the hammer pin hole 56 and the hammer sear 19. The particular features which are machined into the steel casting of the trigger body 35 are the user interface 20, the cam member hole 25, the cam member pin hole 26, the trigger sear 18, the cam member support 27 and the trigger pin hole 55.

In particular, the cam member hole 25 is to be drilled into the steel casting of the trigger body 35 at the proper location, angle, width and depth to provide proper clearance for both the cam member spring 23 and the cam member 22. The angle and location at which the cam member hole 25 is drilled is chosen such that the cam member 22 provides a particular angle of the second surface 58, as described in FIG. 12, such that proper function of the present invention is provided. This angle of the second surface 58 influences the amount of force from the hammer spring 17 which is transferred into the trigger body 35. In order to ensure proper function of the present invention. As described in the figures, the angle and location at which the cam member hole 25 is drilled may be modified from that which is depicted in FIG. 12 in order to increase or decrease the force from the hammer spring 17 which is transferred into the trigger body 35. Furthermore, the particular strength of the hammer spring 17 may be modified to ensure proper function of the present invention As described in the figures. Furthermore, the particular strength of the trigger spring 16 may be modified to adjust the specific attributes of the return bias of the trigger body 35 and ensure proper function of the present invention As described in the figures. Attention should be given to the angle, geometry and finish of the trigger sear 18 and hammer sear 19 such that a configuration which performs the functions of the rapid reset fire control 1 As described in the figures is achieved. Because the present invention may engage with its host firearm in a manner such that the trigger interface is urged into its reset position after firing, trigger springs which are incorporated into embodiments of the present invention may be significantly weakened as they no longer have to be intended for this purpose. Therefore, trigger springs may be chosen to be incorporated into embodiments of the present invention which are significantly weaker than the typical trigger spring. Therefore, the present invention has the benefit of being well suited match grade or target triggers which require a lightened trigger pull, as the selection of a weak trigger spring may help decrease trigger pull weight.

After the aforementioned features are machined into the steel castings, the trigger body 35 and hammer body 36 should be heat treated. Heat treatment of the trigger body 35 and hammer body 36 is beneficial to impart high strength and wear resistance to the parts. In particular the trigger body 35 and hammer body 36 are well suited for the heat treatment process known to the art as case hardening.

Once the aforementioned features are machined into the steel castings and the parts have been heat treated and finished, the trigger body 35 and hammer body 36 are then ready to accept all of their associated features. The associated features which are added unto the hammer body 36 include the hammer pin 13 and the hammer spring 17. The associated features which are added unto the trigger body 35 include the cam member 22, the first surface 46, the second surface 41, the cam member spring 23, the cam member pin 24, the trigger spring 16 and the trigger pin 12.

The cam member 22 of the embodiment of the present invention illustrated in FIG. 1 takes the form of a plunger. This plunger-like form of the cam member 22 as depicted in FIG. 1 has many benefits, including ease of manufacture, low cost, inherent durability and ease of accurate positioning of the first surface 46 and second surface 41 with precision. Additionally, due to the cylindrical shape of the plunger-like form of the cam member 22, the area of contact between the second surface 41 and the hammer surface 59 during operation of the rapid reset fire control 1 is minimized, reducing the inherent friction between these surfaces as they interact.

Said plunger-like cam member 22 is well suited for being manufactured from a steel rod. A steel rod of appropriate material characteristics and diameter is chosen. In particular, a steel rod with a good ability to be hardened is important, as the cam member 22 is subject to friction from the hammer surface 28. After choosing the steel rod, the steel rod is cut to the appropriate length and a slot is machined into one side of the cam member 22 to allow proper clearance for the cam member pin 22. These machining processes which are required to manufacture the cam member 22 are well suited for being performed by a CNC lathe with live tooling. After machining, the cam member 22 may be surface hardened or through hardened using the variety of suitable methods known to the art in order that the cam member 22 be sufficiently strong and durable. The final surface finish of the cam member 22 should be resilient and have a low coefficient of friction, such that drag between the second surface 41 and the hammer surface 59 is reduced during operation of the rapid reset fire control 1. This reduction in drag between the second surface 41 and the hammer surface 59 allows the hammer surface to glide across the second surface 41 to transfer hammer spring 17 force into the trigger body 35.

The cam member support 27 provides several important functions in the embodiment of the rapid reset fire control 1 of FIG. 3. One function of the cam member support 27 is to prevent possible cam member 22 breakage during its use. Another function of the cam member support 27 is allowing for the precise placement of the second surface 41, such that the proper angle of the second surface 58 is achieved, which is important for proper function of the present invention. A particular benefit of said plunger-like cam member 22 is its ability to be used with high strength hammer springs which can ensure reliable function of the present invention and reliable ignition of ammunition primers.

The dimensions, angle and geometry of the hammer surface 28 of the hammer assembly 15 should be configured such that the bolt carrier assembly 11 reattains its in-battery condition at the proper time in the operation of the firearm 2 with the rapid reset fire control 1 so as to allow sufficient time for the bolt carrier assembly 5 to travel fully in the forward direction 31 such that the firearm 2 will be in-battery before the hammer surface 28 is able to impact the firing pin 43 to fire the second shot, as depicted in FIG. 13 and FIG. 14.

The width, depth, length, shape and location of all the features of the rapid reset fire control 1 of FIG. 3 are dimensioned as necessary in order for the present invention to work with the host firearm 2 of FIG. 4 in order to cause the desired functions in the firearm 2 as described in the figures. Furthermore, the width, depth, length, shape and location of all features may be dimensioned as necessary in order for the present invention to function properly when utilized with various types of host firearms other than the firearm 2 depicted in FIG. 4. Furthermore the rapid reset fire control 1 may be configured such that a selector switch may change the firing mode of the rapid reset fire control 1 or alter the forces of spring bias of the rapid reset fire control 1.

The cam member 22 may alternatively be produced in a mechanical form other than a plunger, including but not limited to the form of a lever, a flat spring, hook or toggle which is configured with geometry which temporarily transfers hammer spring 17 force to the trigger body 35 in an equivalent manner to the cam member 22 illustrated in FIG. 1 through FIG. 16. The cam member 22 may also alternatively be mounted to the hammer body 36 configured with geometry which temporarily transfers hammer spring 17 force to the trigger body 35 in an equivalent manner to the trigger body 35 mounted form of the cam member 22 illustrated in FIG. 1 through FIG. 16. The cam member support 27 may alternatively be produced in a mechanical form other than a monolithic structure, including but not limited to a spring, a spring loaded bearing or a surface with an interaction spring. In some alternative embodiments, certain associated features may be eliminated or combined with other features, including the cam member support 27, cam member hole 25, cam member pin 24, cam member pen hole 26, cam member spring 23 and trigger spring 16. In embodiments of the rapid reset fire control 1 in which the cam member 22 is produced in the form of a hook or toggle, the pivot pin for the toggle or hook may be positioned on the trigger body 35 or hammer body 36 as required such that the functions of the rapid reset fire control 1 are performed As described in the figures.

The present invention may differ in arrangement, geometry, dimensions and operation as necessary to allow for proper function in various types of host firearms. Host firearms for which the present invention is particularly well suited for incorporation include, but are not limited to: the AR-10 type rifle and its derivatives, the AR-15 type rifle and its derivatives, the AR-18 type rifle and its derivatives, the AK-47 type rifle and its derivatives, the IWI Tavor type rifle and its derivatives, the FN SCAR type rifle and its derivatives, the Galil type rifle and its derivatives as well as other self-loading firearms which are of utility.

The above exemplary embodiments of the present invention can be integrated with, made for or adapted to many types of firearms which are known to the art, these firearm types include but are not limited to handguns, sub-machine guns, shotguns, carbines, rifles and machine guns and many other firearm configurations which are known to the art. The above exemplary embodiments of the present invention can be integrated with, made for or adapted to firearms with various types of firearms operating systems which are known to the art, these firearm operating system types include but are not limited to blowback operation, recoil operation and gas operation. The above exemplary embodiments of the present invention can be integrated with, made for or adapted to many types of firearm fire control groups which are known to the art, these firearm fire control group types include but are not limited to match grade triggers, combat triggers, adjustable triggers, single stage triggers, two stage triggers, multifunction triggers, triggers with integrated safety systems and many other firearm fire control group configurations which are known to the art. This description is made in terms of exemplary and alternative embodiments, and is not intended to be so limited.

What is claimed is:

1. A system for facilitating rapid firing of firearms, comprising: a firearm (2), said firearm comprising:

a hammer body (36), said hammer body being configured to rotate about a hammer pin (13), said hammer body comprising a hammer sear (19), said hammer sear being displaced along a path of travel (63) as said hammer body rotates about said hammer pin;

a hammer spring (17) configured to rotationally bias said hammer body towards engagement with a firing pin (43);

a trigger body (35), said trigger body comprising a trigger sear (18) and a trigger interface (20), said trigger body being configured to rotate about a trigger pin (12); and a cam member (22) disposed along said trigger body, said cam member comprising a first surface (46) and a second surface (41), said hammer body being engageable with said first surface such that said cam member is displaced with respect to said trigger body, a slidable engagement between said hammer body and said second surface being configured such that bias from said hammer spring causes said trigger body to rotate about said trigger pin such that said trigger sear rotates into said path of travel of said hammer sear as said trigger interface is manipulated by a rearward force (47) sufficient to cause the discharge of said firearm.

2. A fire control mechanism for increasing the firing rate of a firearm comprising:

a trigger assembly (14) comprising:

a trigger body (35) having a trigger interface (20) and a trigger sear (18), said trigger body configured to rotate about a trigger pin (12);

a cam member spring (23), said cam member spring seated against said trigger body;

a cam member (22) having a first surface (46) and a second surface (41), said cam member seated against said cam member spring such that said first surface is biased away from said trigger body; and a hammer assembly (15) comprising:

a hammer body (36) having a hammer surface (28) and a hammer sear (19), said hammer body configured to rotate about a hammer pin (13), said hammer sear being displaced along a path of travel (63) as said hammer body rotates about said hammer pin;

a hammer spring (17) configured to rotationally bias said hammer body about said hammer pin toward a firing pin (43); and wherein, upon manipulation of said trigger interface by a rearward force (47) such that said firearm discharges, impetus from the discharge of said firearm causes a bolt carrier surface (11) to engage said hammer body such that said hammer body is rotated toward said cam member such that said hammer surface comes in contact with said first surface; and wherein said hammer spring imparts rotational force against said hammer body causing said hammer body to impart a rotation upon said trigger body by a cam engagement between said hammer surface and said second surface; and wherein the above-recited rotation of said trigger body causes said trigger sear to rotate into said path of travel of said hammer sear as said trigger interface is manipulated by said rearward force sufficient to cause the discharge of said firearm.

3. The fire control mechanism as recited in claim 2, wherein said cam member is configured such that engagement between said hammer surface and said first surface causes said cam member to be displaced with respect to said trigger body, said hammer surface disengaging from said first surface such that said second surface is displaced into an arcing path of travel of the hammer surface (59) by the bias of the cam member spring.

4. The fire control mechanism as recited in claim 2, wherein said cam engagement is configured such that said hammer surface disengages from said second surface after said trigger sear is rotated into said path of travel of said hammer sear.

* * * * *